United States Patent [19]

Takeda et al.

[11] 3,948,201

[45] Apr. 6, 1976

[54] POSITION CORRECTION SYSTEM OF FLOATING BODIES

[75] Inventors: Isamu Takeda, Naka; Ietoshi Yamura, Tokyo; Shojiro Yamada, Ichikawa; Yoshio Seki, Tokyo, all of Japan

[73] Assignee: Mitsui Shipbuilding & Engineering Co., Ltd., Tokyo, Japan

[22] Filed: Apr. 21, 1975

[21] Appl. No.: 570,026

[30] Foreign Application Priority Data

Apr. 23, 1974 Japan ..... 49-45057
Apr. 23, 1974 Japan ..... 49-45058

[52] U.S. Cl. ..... 114/144 B; 114/206 R; 114/230
[51] Int. Cl.[2] ..... B63H 25/00; B63B 35/44
[58] Field of Search ..... 114/144 R, 206 R, 230, 114/.5 D, 144 B; 254/173 R, 173 A, 173 B

[56] References Cited

UNITED STATES PATENTS

| | | | |
|---|---|---|---|
| 3,422,783 | 1/1969 | Moulin | 114/230 |
| 3,580,207 | 5/1971 | Pangalila | 114/144 B |
| 3,596,070 | 7/1971 | McCool et al. | 114/206 R |
| 3,886,887 | 6/1975 | Cunningham et al. | 114/144 B |

*Primary Examiner*—Trygve M. Blix
*Assistant Examiner*—Stuart M. Goldstein
*Attorney, Agent, or Firm*—Charles E. Pfund

[57] ABSTRACT

The position of a ship moored by at least three anchor ropes extending between the ship and independent remote anchor points is corrected by a control system comprising a rope orientation angle detector, a device for designating the angle and amount of movement of the ship which are necessary to correct the position of the ship, a position correction parameter designating device which determines whether parallel movement or swinging movement is to be made to correct the position of the ship and sends the result of determination to the rope orientation angle detector, a deviation operator which compares the angle of movement with the rope orientation angle for producing an output corresponding to the differential angle, a rope extension and contraction control device responsive to the outputs from the deviation operator and the rope orientation angle detector for producing an output for commanding paying out or taking up of respective anchor ropes, and winches mounted on the ship for operating respective anchor ropes and controlled by the output from the rope extension and contraction control device which includes a device for increasing or decreasing the length of each anchor rope by one unit length and a device for controlling the next unit length when each rope is stabilized after completion of the control of the first unit length thereby moving the ship to a position designated by the rope orientation angle detector in accordance with the determination made by the position correction parameter designating device.

22 Claims, 27 Drawing Figures

FIG.8

| ROPE NO. | ROPE OPERATION | DIFFERENTIAL ANGLE |
|---|---|---|
| 8a | PAY OUT (ELONGATION) | SECOND QUADRANT 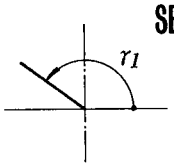 $\gamma_1 = \beta_1 - \alpha$ |
| 8b | TAKE IN (CONTRACTION) | FIRST QUADRANT 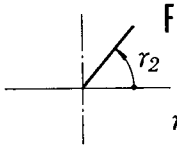 $\gamma_2 = \beta_2 - \alpha$ |
| 8c | TAKE IN (CONTRACTION) | FIRST QUADRANT 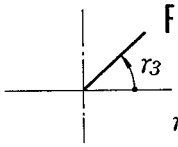 $\gamma_3 = \beta_3 - \alpha$ |
| 8d | TAKE IN (CONTRACTION) | FOURTH QUADRANT 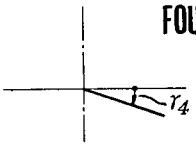 $\gamma_4 = \beta_4 - \alpha$ |
| 8e | TAKE IN (CONTRACTION) | FOURTH QUADRANT 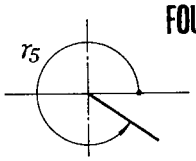 $\gamma_5 = \beta_5 - \alpha$ |
| 8f | TAKE IN (CONTRACTION) | FOURTH QUADRANT 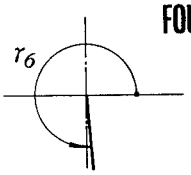 $\gamma_6 = \beta_6 - \alpha$ |
| 8g | PAY OUT (ELONGATION) | THIRD QUADRANT 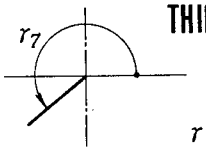 $\gamma_7 = \beta_7 - \alpha$ |
| 8h | PAY OUT (ELONGATION) | THIRD QUADRANT 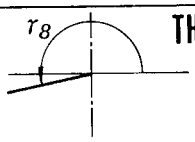 $\gamma_8 = \beta_8 - \alpha$ |

$r_n$ IS ACUTE $r_n$ IS OBTUSE 11
12
13
14
15
16
17
18
19
20
21
22
23
24
31
32
33
34
35
36
37
38
39
40
41
42
43
44
45
46
47
48
49
50
51
52
311
312
341
342
343
8a
8b
-E
±0
+E

POSITION CORRECTION SYSTEM OF FLOATING BODIES

BACKGROUND OF THE INVENTION

This invention relates to a system for correcting the position of a floating body, more particularly a ship floating on water and moored in an operating position by means of a plurality of anchor ropes.

In an operating ship anchored by a plurality of anchor ropes it is often necessary to linearly move the ship over a small distance (several tens cm to several tens meters) or rotate the ship for the purpose of correcting the variation in the position of the ship caused by tidal flow, wind or the tide of sea water. According to one prior art method of correcting the position of the ship, a model of the ship is moved or rotated to measure the variations of the lengths of the ropes connected to the model ship, and the variations in the lengths of the anchor ropes which are proportional to the measured variations are transmitted to a winch operator for operating winches mounted on various portions of the moored ship. However, this method is not advantageous in that it is necessary to calculate the elongation and contraction of the ropes, and that a number of winch operators should cooperate with each other to manipulate a large ship which requires a high degree of skill and precise judgement so that such operation is extremely troublesome and requires time.

SUMMARY OF THE INVENTION

Accordingly, it is an object of this invention to provide an improved ship mooring system.

Another object of this invention is to provide a novel system of correcting the position of a body floating on water capable of correcting the position by a simple operation and in a short time.

A further object of this invention is to provide a novel system of correcting the position of a floating body which does not require any special calculation of the length of elongation and contraction of the anchor ropes for the purpose of correcting the position of the floating body.

According to this invention there is provided a position correction system of a floating body which is moored by at least three anchor ropes extending between the floating body and remote independent stationary anchoring points, said position correction system comprising means for detecting the orientation angle of each anchor rope; means for designating the angle of movement and the amount of movement of the floating body which are necessary to correct the position of the floating body; position correction parameter designating means which determines whether parallel movement or swinging movement is to be performed to correct the position of the floating body and sends the result of determination to the first mentioned means; a deviation operator which compares the angle of movement with the rope orientation angle for producing an output corresponding to the differential angle; a rope extension and contraction control device responsive to the output from the deviation operator and the output from the first mentioned means for producing an output for commanding paying out or taking up of respective anchor ropes; and winches mounted on the floating body for operating respective anchor ropes and controlled by the output from the rope extension and contraction control device; said rope extension and contraction control device including means for increasing or decreasing the length of each anchor rope by one unit length, and means for controlling the next unit length when each extended anchor rope is stabilized after completion of the control of the first unit length, thus moving the floating body to a position designated by the first mentioned means in accordance with the determination made by the position correction parameter designating means.

BRIEF DESCRIPTION OF THE DRAWINGS

Further objects and advantages of the invention will be more fully understood from the following detailed description taken in conjunction with the accompanying drawings in which:

FIG. 8 is a diagram for explaining the relationship between the operations of respective ropes and the differential angles thereof.

DESCRIPTION OF THE PREFERRED EMBODIMENTS

Figure 1:
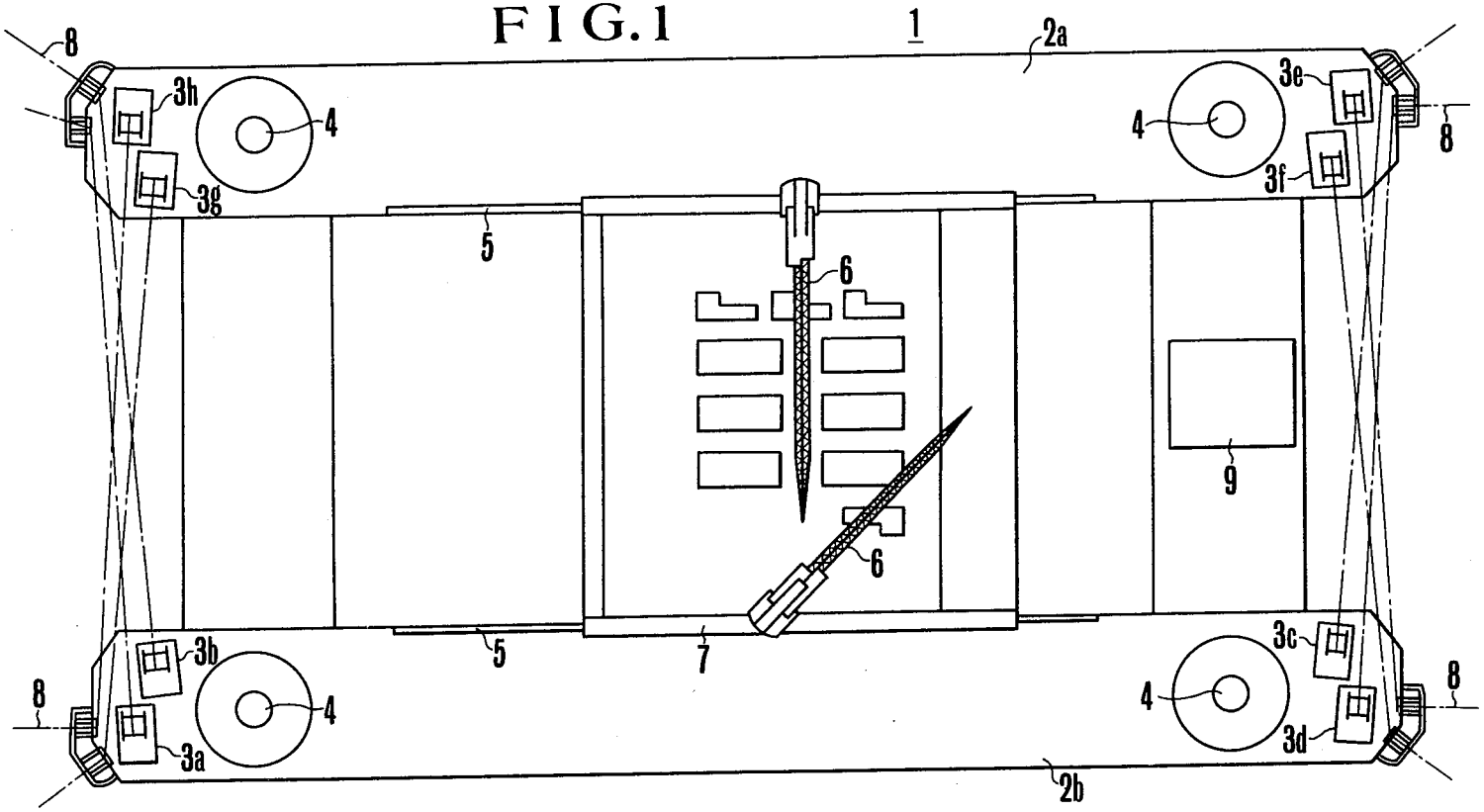
FIG. 1 is a plan view of one example of a typical working or operating ship to which the position correction system of this invention is applicable.

Generally a floating body on sea water (hereinafter designated as a working or operating ship having a flat operating surface) can be moved in the longitudinal and transverse directions (hereinafter termed parallel movement) to any desired position or swinged by any desired angle by elongating or contracting a plurality of anchor ropes connected to the ship. A condition for minimizing the number of such anchor ropes is as follows except certain special cases. For example, three points corresponding to the apices of a triangle on the ship are selected as reference points to which the ropes are connected respectively, and two ropes are extended from each reference point, thus using a total of six ropes. In such an arrangement the range in which the ship can swing or make a parallel movement is limited by the positions of the reference points on the ship and the positions of the stationary anchoring points at the other ends of the ropes. It is possible to widen the range of parallel movement and swinging movement of the ship by increasing the number of the reference points to four or more or by increasing the number of ropes extending from a point near each reference point to three or more whereby the tension of each rope can be reduced. Where the number of the reference points is increased to four or more than four, it is not necessary to connect two ropes to each reference point. Even when only one rope is connected to certain reference points substantially parallel movement and swinging movement are possible in a limited range. Further, it should be understood that it is not always necessary to arrange the reference points on the apices of a triangle and that the reference points may be arranged on the apices of any polygon. For this reason, the configuration of the working ship may be triangular, polygonal or circular or any other suitable shape when viewed from above.

In the following example, a rectangular working ship having sides several tens meters long and two ropes each having a length of about 100 to 500m are connected to each corner of the rectangle for the purpose of enabling parallel movements of from several tens centimeters to several tens meters or swinging movements of relatively small angles of from several degrees to several tens degrees. Further, it is intended to limit the error of the position to be less than 30 cm when the ship is to be moved about 10 meters or swing about 10°.

The anchors on the outer ends of respective anchor ropes are fixed to the sea bottom so that the positions of the anchors are held unchanged. The length of the rope is varied manually or automatically so as to maintain respective ropes under suitable tension while the working ship is maintained stationary. Thus, the ropes are not slackened. Each rope is suspended vertically in the air but near the anchor the rope is submerged in the sea water. Prior to and after movement the manner of suspending each rope should be substantially equal. When an anchor winch pays out or takes up an anchor rope, the variation in the length of the rope results in the variation in the length of the rope submerged in water.

To have better understanding of the illustrated embodiment, some important items are enumerated as follows:

1. Eight ropes having desired length are extended in the desired directions.
2. Each anchor winch is driven by an oil pressure motor, and the forward and reverse operations and the stopping thereof are controlled by electromagnetic values included in the oil pressure circuit.
3. To decrease the length of the rope for moving the ship, the winch should be operated along a characteristic curve passing (as far as possible) through a point of the maximum torque and the minimum speed.
4. The lengths of elongation and contraction of the ropes of each winch are predetermined and the drum of the winch is rotated to provide such lengths. The required length of elongation or contraction of the rope is approximately proportional to the product of the stroke of the reference point on the ship caused by the parallel movement or swinging movement of the ship and the cosine of the differential angle. The differential angle is defined herein to mean the difference between the orientation angle of the rope at the reference point on the ship and the angle of movement of the ship. This will be described later in more detail.
5. A voltage proportional to the cosine of the differential angle is derived out from an input potentiometer.
6. A voltage proportional to the length of elongation or contraction of the rope is derived out from an output potentiometer.
7. Position control is performed step by step. In one cycle, a movement of one unit (at the time of parallel movement, one unit distance, whereas at the time of swinging, one unit swinging angle) is performed, and such cycle is repeated N times.
8. The circuit parameters are preset such that as the drum of the winch rotates to vary the length of the rope, the voltage from the output potentiometer varies and that as the drum is rotated to vary the length of the rope by a desired amount the voltage from the output potentiometer becomes equal to that from the input potentiometer so as to stop the operation of the winch.

9. The length of one cycle of the operation is predetermined by taking such factors into consideration as the completion of all winches, and the interval in which the transient condition of the coasting of the ship and tensioning of the rope have ceased, that is, the ship and the rope have become stable.

10. During the measurement and control, the angle is transmitted to remote position through Selsyn motors.

A preferred embodiment of this invention will now be described with reference to the accompanying drawings.

Figure 2:
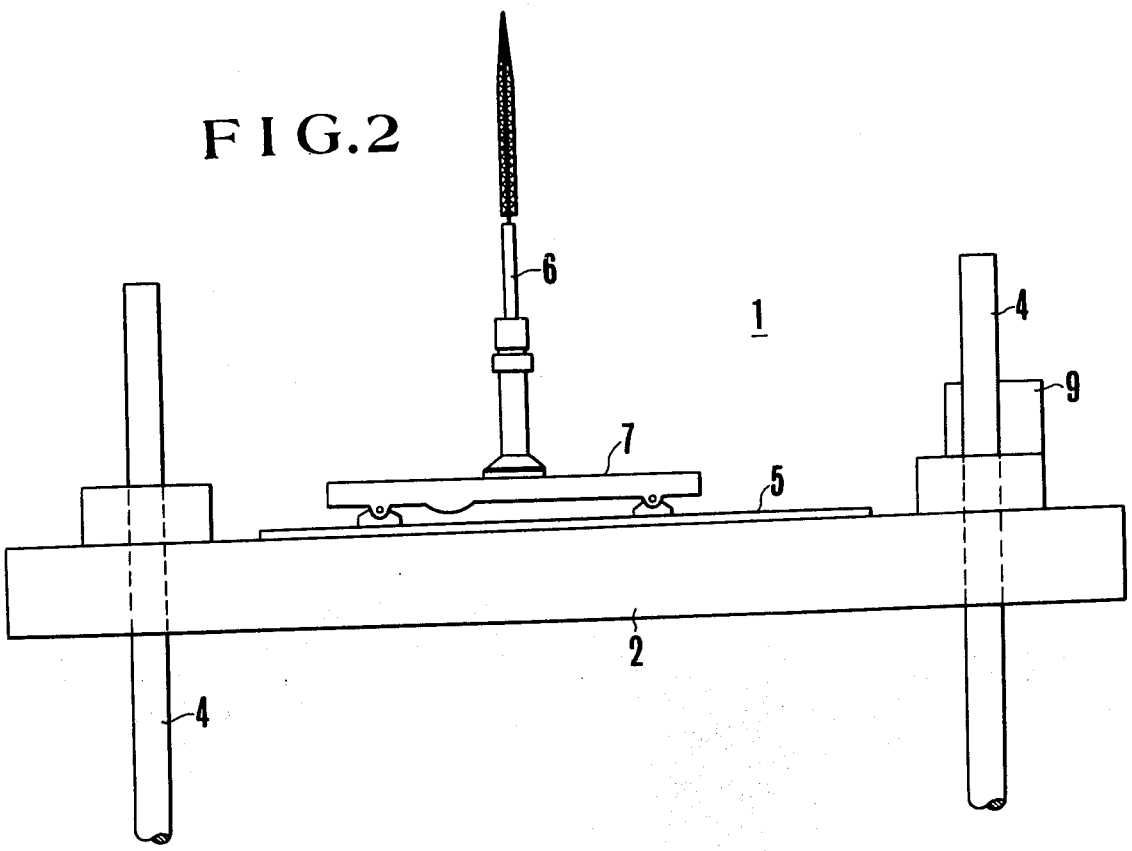
FIG. 2 is a side view, partly broken away, of the working ship shown in FIG. 1.

FIGS. 1 and 2 show a plan view and a side view of an anchored working ship embodying the invention. The ship 1 is constructed as a twin hull ship including two hulls 2*a* and 2*b*. Pairs of winches 3*a* – 3*b* are provided at respective corners of the ship. Legs 4 which are driven into the sea bottom may be provided at respective corners, in which case means (not shown) for raising and lowering the legs are provided. Rails 5 are mounted on respective hulls 2*a* and 2*b* for supporting a movable carriage 7. Two anchor ropes 8 (hereinafter designated by 8*a* – 8*h*) extend in any desired directions from each corner.

Figure 3:
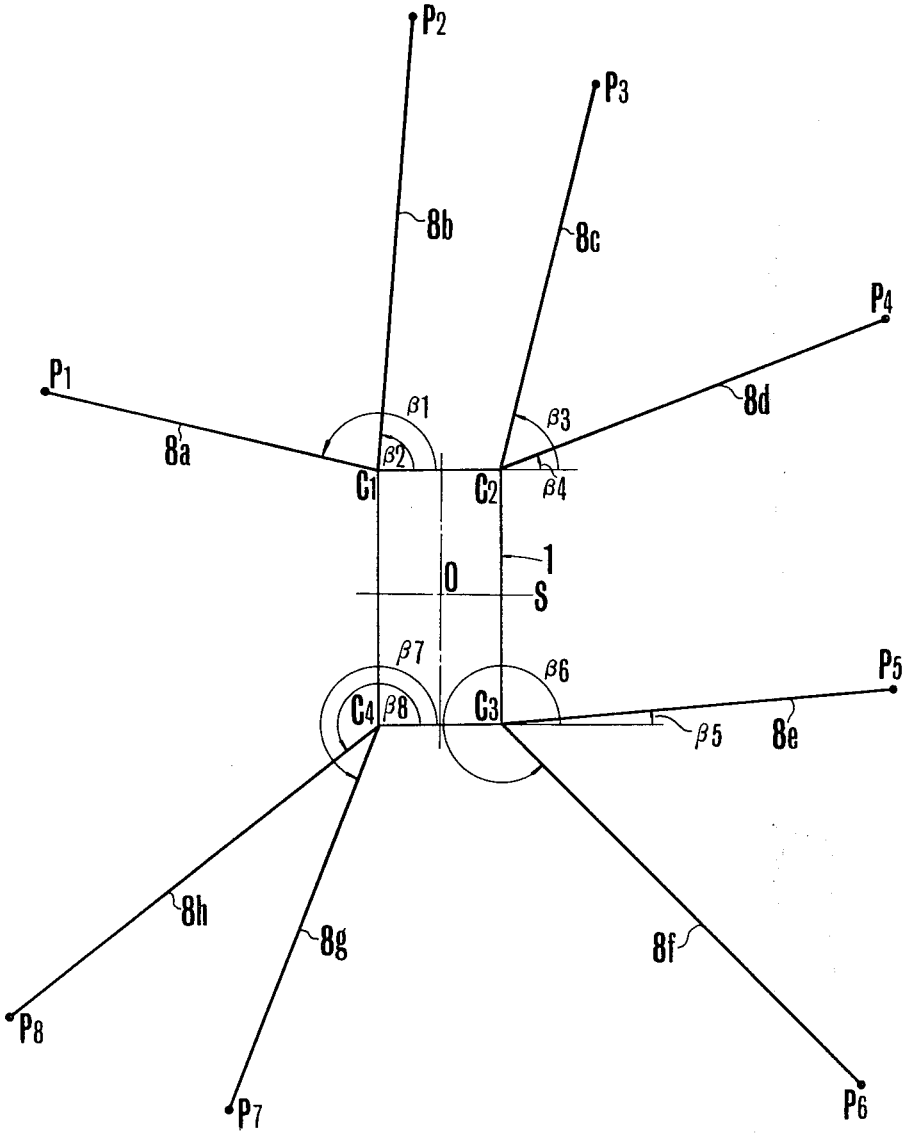
FIG. 3 is a diagram for explaining the relationship between the working ship and the angles of the anchor ropes relative to the ship.

The operative relationship between anchor ropes 8 and the working ship will be described hereunder with reference to FIG. 3, in which anchor ropes extending from respective corners are designated by reference numerals 8*a* through 8*h*, and respective anchor points by P1 through P8. C1 – C4 correspond to aforementioned reference points and in this example termed corner reference points. These corner reference points are arranged at respective corners of a rectangle and approximately correspond to the points from which anchor ropes 8*a* through 8*h* extend. The center of the ship is denoted by 0 and a straight line passing through the center 0 and extending toward the starboard by OS. It is now defined that any straight line parallel to line OS and extending toward the starboard is the reference line of the angle. $\beta 1$ through $\beta 8$ represent the orientation angles of respective anchor ropes 8*a* through 8*h* with respect to the reference lines, the angles being taken as positive for counterclockwise rotations and negative for clockwise rotations.

In FIG. 1, the control room of the working ship is designated by 9 and contains various control panels for various portions of the ship. If desired, the control room 9 may be mounted on the carriage 7. Further, the control room may be divided into a plurality of small compartment, which are distributed at convenient points to contain appropriate control panels.

Figure 4:
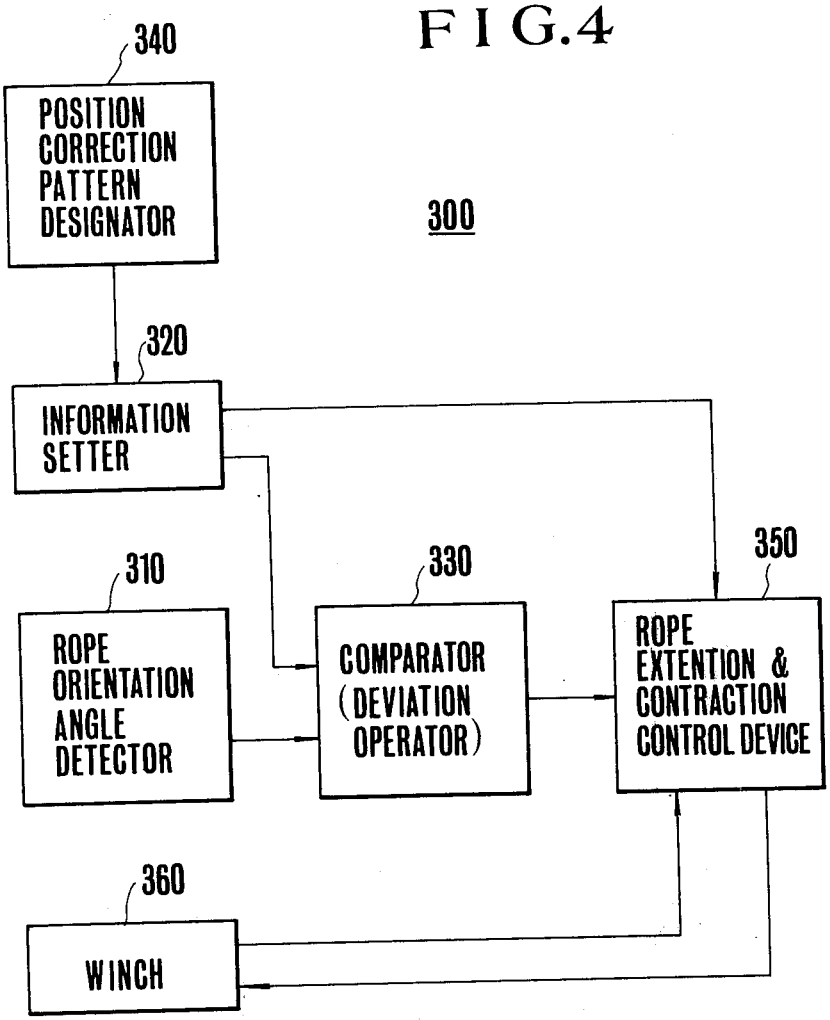
FIG. 4 is a block connection diagram showing the basic element of the novel system of correcting the position of a floating body.

FIG. 4 is a block diagram showing the basic construction of a position correction system 300 utilized in this invention. The position correction system 300 comprises a detector 310 for detecting the orientation angle of the rope extending from each corner of the working ship shown in FIG. 1 and an information setter 320 in which input information necessary for effecting the parallel movement or swinging movement for the purpose of correcting the position of the working ship is set manually. In this example, the orientation angle and the stroke are used as the information where the parallel movement is to be performed whereas in the case of the swinging movement the direction and angle of swinging are used as the information. The position correction system 300 further comprises a comparator 330 which compares the output signal from the rope orientation angle detector 310 with the output from the information setter 300 to produce the difference therebetween or to operate as a deviation operator. In this example, the deviation is derived out as a signal proportional to the cosine of the deviation angle. There are also provided a position correction pattern designator 340 which functions to determine whether the pattern required to correct the position of the working ship is a pattern for parallel movement or a pattern for swinging for modifying the circuit construction of the information setter 320, a control device 350 for controlling the length of elongation and contraction of the rope, and a winch connected to respond to the output from the control device 350 for paying out and taking up the rope. The rope extension and contraction control device 350 provides a signal to the winch 360 in response to the signal regarding the stroke sent from the information setter 320 for stepwisely paying out and taking up the anchor rope by a unit length. The operation of the control device is terminated when the output from the comparator or deviation operator 330 and information sent from the winch and representing the length of the anchor rope actually paid out or taken up become equal. In this example, a potentiometer is used for detecting such coincidence.

Actually, the winch 360 comprises a plurality of winches disposed at each corner of the working ship.

With this construction, the rope extension and contraction control device 350 stepwisely increases or decreases the length of each anchor rope until a position correction corresponding to the output of the information setter 320 is performed. Upon completion of the control of one unit length and after the condition of each anchor rope has been stabilized, the control for the next unit length is performed. In this manner, the working ship is moved to a new position designated by the information setter 320.

Figure 5:
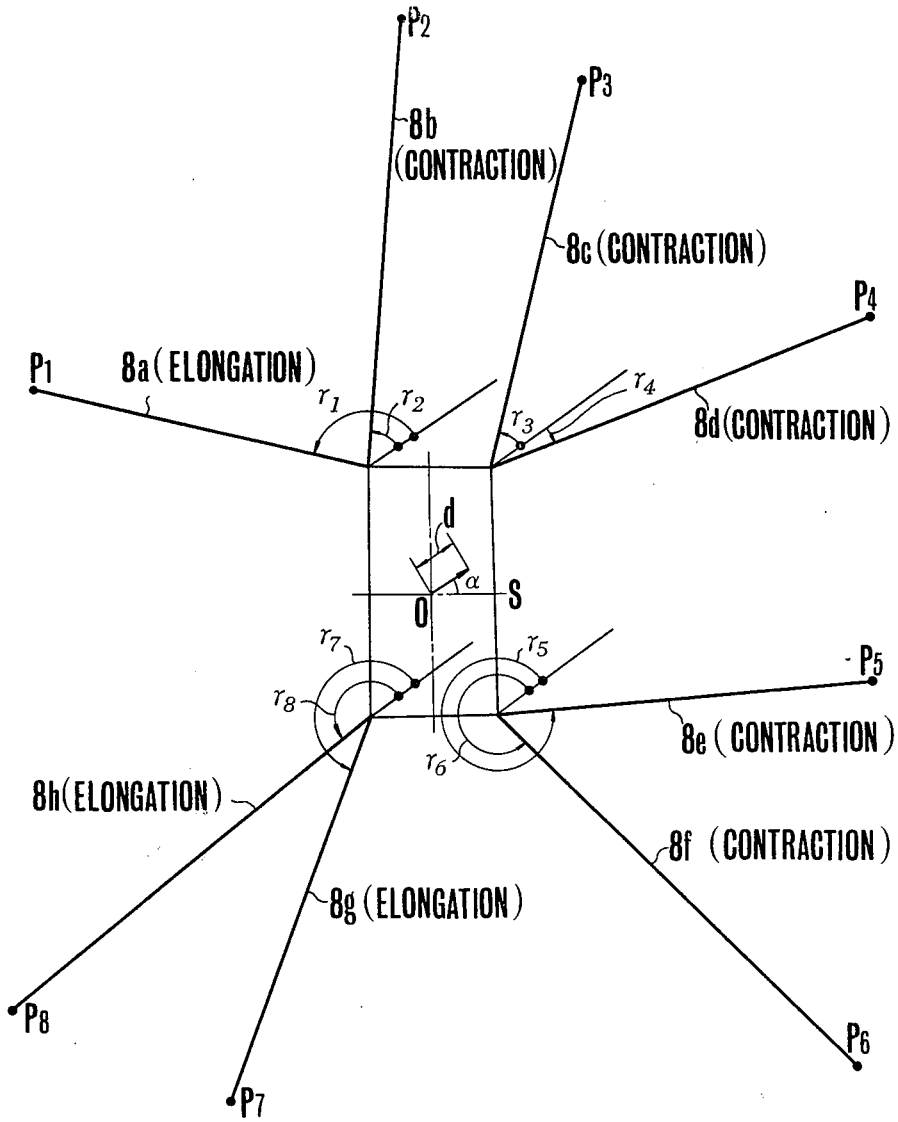
FIG. 5 is a diagram showing the differential angles of respective anchor ropes corresponding to the difference between the angles of the ropes and the angle of rotation of the floating body when parallel movement is performed.

Various parameters utilized to perform a parallel movement and a swinging movement of the working ship anchored as described above are selected as follows. Where the parallel movement of the working ship is to be performed, the various parameters utilized in this operation are shown in FIG. 5 in which $\alpha$ represents the orientation angle of the working ship after the parallel movement, $d$ the stroke or the distance of movement, and $\gamma 1$ through $\gamma 8$ the differential angles of respective anchor ropes. $\gamma n (n = 1, 2 \ldots 8)$ show differential angles for a swinging movement.

Figure 6:
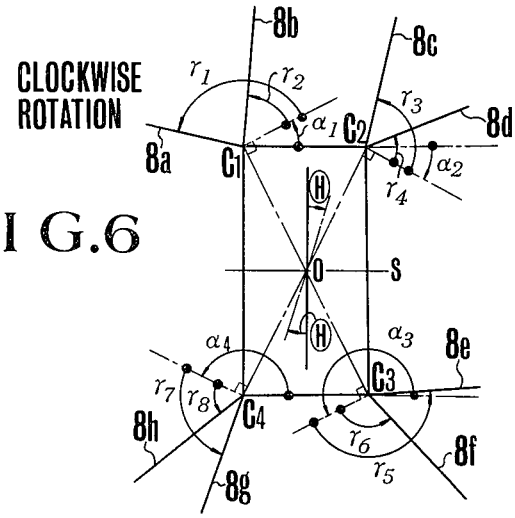
FIGS. 6 and 7 are diagrams showing the differential angles of respective anchor ropes corresponding to the difference between the angles of the ropes and the angle of movement of the corner reference points when the floating body is rotated in the counterclockwise direction and clockwise direction, respectively.
Figure 7:
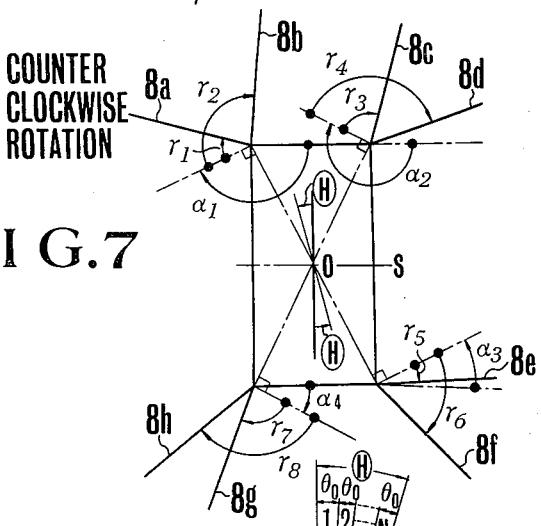

FIGS. 6 and 7 show the parameters for clockwise swinging and counterclockwise swinging respectively in which $\alpha 1$ through $\alpha 4$ represent orientation angles of respective corner reference points C1 through C4 with respect to the reference line when a clockwise (or counterclockwise) rotation is to be made.

Figure 20:
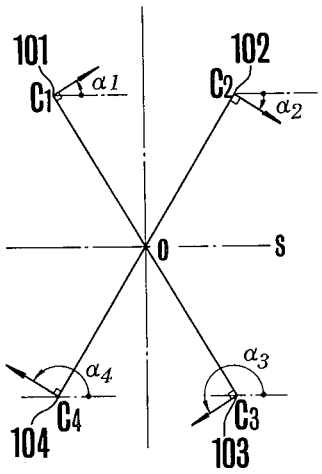
FIG. 20 is a diagram showing that the angle of movement of the corner reference point at the time of clockwise swinging movement always has a definite value with respect to a reference line.

In the case of a clockwise swinging, as shown in FIG. 6 or FIG. 20, the orientation angles present in the direction of normals on the righthand sides of dotted lines OC1 – OC4 each passing through the center 0 of the ship. In the case of a counterclockwise swinging the orientation angles present in directions 180° apart from those of the clockwise swinging.

For simplifying the description the same symbols $\alpha$ and $\gamma$ are used in FIGS. 5, 6 and 7 for both parallel movement and swinging movement.

Figure 9:
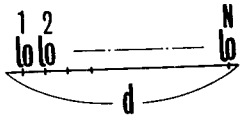
FIG. 9 is a diagram showing that the total distance of movement or stroke is equal to an integer multiple of the distance of a unit movement at the time of the parallel movement.

Under the assumptions described above, the conditions of elongation and contraction of eight ropes at the times of parallel movement and swinging movement will now be considered. The conditions of elongation and contraction of the ropes, that is whether the ropes are elongated (paid out), contracted (taken up) or no elongation or contraction are determined in accordance with the values of the differential angles $\gamma n$ ($n = 1, 2 \ldots 8$). More particularly, as shown in FIG. 8, 1. Where the differential angle $\gamma n$ is an acute angle satisfying a relation $-90° < \gamma n < 90°$, the rope is taken up.
2. Where the differential angle $\gamma n$ is an obtuse angle satisfying a relation $90° < \gamma n < 270°$ the rope is paid out.
3. Where $\gamma n = +90°$, the rope is neither elongated nor contracted.

Where the parallel movement is to be done at least more than one of the differential angles should be acute angles to take up the ropes.

Where the total distance of the movement or stroke is denoted by $d$ as shown in FIG. 9 the ship is moved stepwisely over a plurality of unit distances $l_o$. Thus, the ship completes its stroke $d$ by repeating N times the travel of the unit distance $l_o$, that is $d = Nl_o$.

Figure 10A:
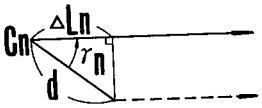
FIGS. 10A and 10B are diagrams showing that the product of the total distance of movement and the cosine of the differential angle is equal to the desired length of elongation and contraction of the ropes.
Figure 10B:
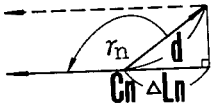
Figure 11:
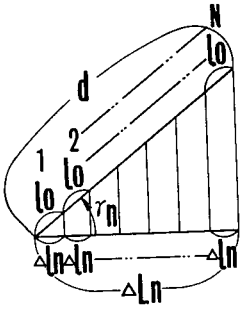
FIG. 11 is a diagram showing the required length of elongation and contraction of the rope for the total distance of movement and the distance of a unit movement.

As shown by FIG. 10, the length of elongation of the rope $\Delta Ln$ required for the stroke $d$ can be expressed approximately by $\Delta Ln = d|\cos \gamma n|$. In the case shown in FIG. 10A $n$ is an acute angle meaning that the rope should be contracted for moving the working ship whereas in the case shown in FIG. 10B $\gamma n$ is an obtuse angle meaning that the rope should be elongated. FIG. 11 shows the relationship between total stroke $d$, unit stroke $l_o$ and the required lengths of the rope elongated and contracted $\Delta Ln$ and $\Delta ln$.

The value of $l_o$ is selected to be a minimum distance required for the operation, and the control system is designed to be able to switch the value of $l_o$ among large, medium and small, the minimum distance being included in these values.

Figure 12:
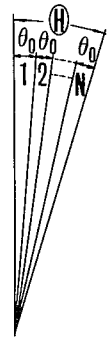
FIG. 12 is a diagram showing that the total swinging angle is equal to an integer multiple of a unit swinging angle at the time of swinging movement.
Figure 13:
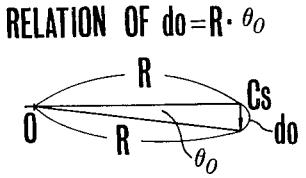
FIG. 13 is a diagram showing the distance of movement of a corner reference point with respect to a unit swinging angle.
Figure 14A:
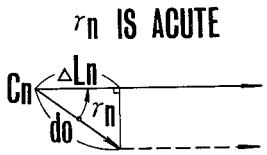
FIGS. 14A and 14B are diagrams showing the required length of elongation and contraction of the rope for the distance of movement of a corner reference point.
Figure 14B:
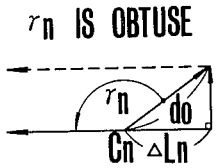

In the case of the swinging movement, where the total swinging angle of the workship is denoted by Ⓗ, the control system is designed such that the total swinging angle Ⓗ can be reached by repeating N times the operations of smaller unit swinging angles $\theta_o$. FIG. 12 shows this relation.

Where the working ship is rotated by a unit swinging angle, the distance of movement $d_o$ of respective reference points C1 through C4 at respective corners is shown approximately by an equation $d_o = R. Ⓗ_o$ as shown in FIG. 13, if it is assumed that OCs = R (Os represents any one of the reference points). When performing swingings of unit swinging angle $Ⓗ_o$ in each cycle, the required length of elongation or contraction $\Delta Ln$ ($n = 1, 2 \ldots 8$) of respective ropes can be shown approximately by an equation $\Delta Ln = d_o|\cos \gamma n|$ as shown in FIG. 14. In the case shown in FIG. 14A, $\gamma n$ is an acute angle so that it is necessary to take up the rope at the time of swinging, whereas in the case shown in FIG. 14B, $\gamma n$ is an obtuse angle so that it is necessary to pay out the rope. In the equation just described the magnitude of the differential angle $\gamma n$ continues to vary slightly during the unit swinging angle. As a result, the voltage of the input potentiometer which is proportional to $|\cos \gamma n|$ also continues to vary slightly. However, the voltage of the output potentiometer is zero at the commencement of the rotation of the winch drum, and increases substantially in proportion to the rotation of the drum. Since the rate of this change is larger than the rate of change of the voltage of the input potentiometer, the voltage of the output potentiometer always reaches a value which is equal to the voltage of the input potentiometer so long as the winch drum continues to rotate in the same direction. Let us denote the length of elongation or contraction of the rope by $d_o|\cos \gamma n|$, $\gamma n$ represents the value of the unit swinging angle at the last point of the swinging. It is possible to consider that $\gamma n$ is approximately constant within the range of the unit swinging angle.

Advantages caused by step-by-step unit movement are as follows.

1. Whether the working ship is moved over only one unit distance $d_o$ or over the entire stroke $d$ and whether the working ship is rotated over only a unit swinging angle or over the total swinging angle, the required length of elongation and contraction of eight anchor ropes is different in respective cases. Assuming now that the speeds of rotation of respective winch drums are substantially the same, the elongation or contraction of some of the eight ropes will be completed earlier than the other ropes. For this reason, it is difficult to effect smooth parallel movement or swinging and it is inevitable to accompany small swinging motions or zig-zag motions at the time of parallel movement. Further at the time of swinging movement, the movement becomes intermittent or the center of the ship moves slightly. After these irregular motions, the ship is finally brought to the desired position. During such operation, transient undue tensions are often applied to some of the eight anchor ropes. For the purpose of obviating such difficulty, in the case of the parallel movement, instead of moving the working ship over the entire stroke, it is moved stepwisely over a plurality of unit distances $l_o$ with a predetermined interval between the steps for minimizing as far as possible the difference between the instants at which the elongating and contracting operations of eight ropes are completed. Such stepwise operation assures uniform parallel movement.

In the same manner, in the case of the swinging operation, instead of swinging the working ship over the entire swinging angle, more uniform swinging operation can be assured by stepwisely swinging the ship by a small angle $\theta_o$ or a small distance $\Delta Ln$ with a predetermined interval between the steps thereby minimizing as far as possible the difference between the instants at which the elongating and the contracting operations of eight ropes are completed.

2. As the inertia of the ship is large it is possible to decrease the coasting of the ship by bringing the ship to or near standstill after each small parallel movement or swinging movement rather than to move the ship over the entire stroke.

3. At the time of the parallel movement the total stroke $d$ is not required to be constant but may be substituted by an approximate stroke by repeating the movement over the unit distance $l_o$ by N times, where N represents an integer of an indefinite value. Then, the desired length of the contraction or elongation of the rope in one cycle can be provided by controlling only the value $l_o|\cos \gamma n|$ which is necessary for the movement of the constant value $l_o$.

In the same manner, at the time of the swinging operation, it is not always necessary that the total swinging angle Ⓗ is a definite value but may be provided by repeating the swinging operation of the unit swinging angle N times, where N represents an integer of an indefinite value. Then, the desired length of the contraction or elongation of the rope in one cycle can be provided by controlling only the value $\Delta Ln = d_o|\cos \gamma n|$ which is necessary for the swinging of the constant value Ⓗ. Accordingly, the processing of the value N can be made by an ordinally counter, thereby simplifying the entire control system. For providing a unit distance $l_o$ at each cycle of the parallel movement if the desired length of elongation or contraction of each rope is expressed by $\Delta ln(n=1, 2 \ldots 8)$, then $\Delta Ln = n \cdot \Delta ln$. The value of $\gamma n$ in the equation $\Delta ln = l_o|\cos \gamma n|$ continues to vary slightly during the movement over the unit distance $l_o$ so that the voltage of the input potentiometer which is proportional to $|\cos \gamma n|$ also continues to vary slightly. However, the absolute value of the voltage of the output potentiometer is zero at the commencement of the rotation of the winch drum and increases substantially in proportion to the angle of rotation of the winch drum. Since the rate of variation of the latter is larger than the rate of variation of the value of the input potentiometer the value of the output potentiometer always reaches a value equal to the voltage of the input potentiometer. When the length of contraction or elongation of the rope is expressed by $l_o|\cos \gamma n|$, $\gamma n$ represents the value at the time of completing a unit stroke. During the movement in the unit stroke, it may be considered that $\gamma n$ has approximately a constant value.

The operation of the position control system of this invention for both parallel movement and swinging movement will be described in detail as follows.

I. PARALLEL MOVEMENT

Figure 15:
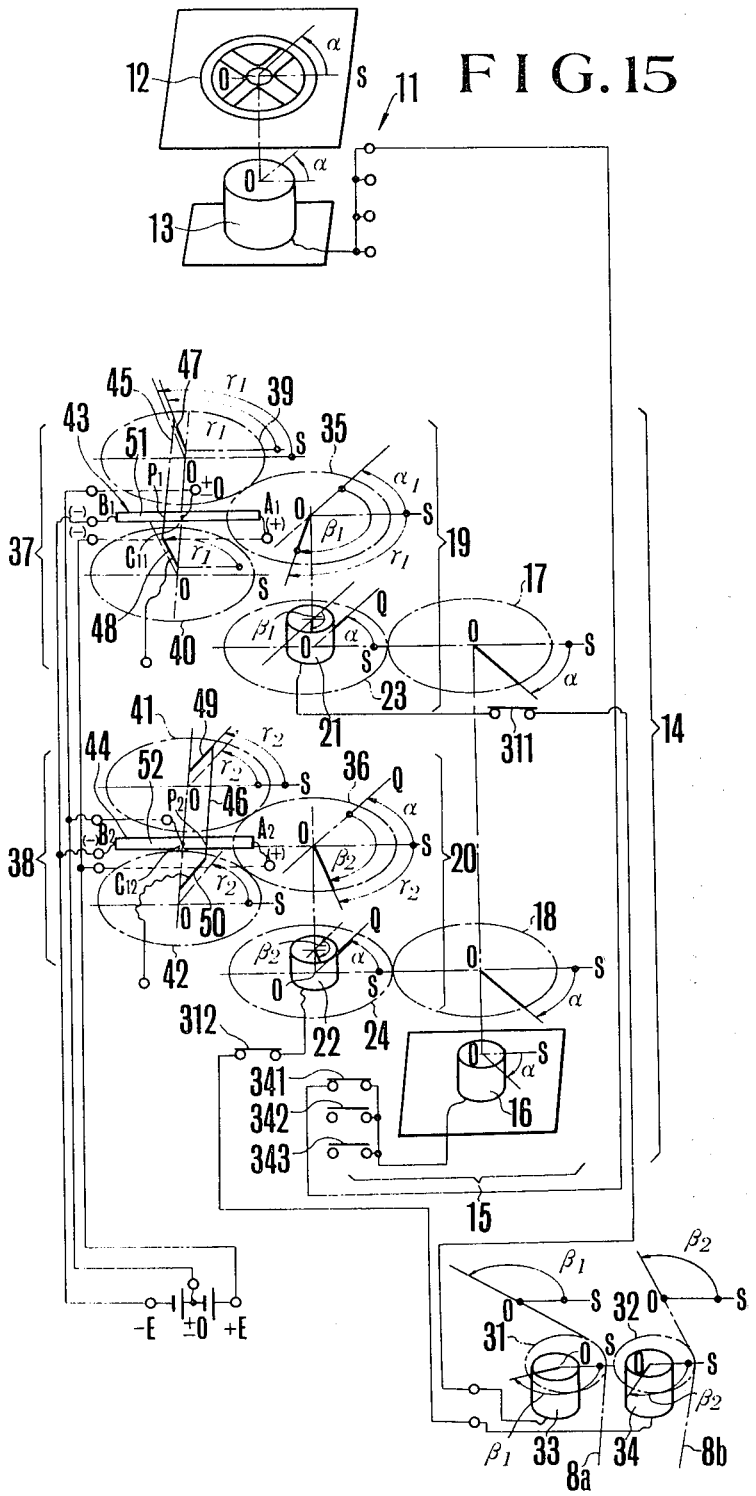
FIG. 15 is connection diagram of various elements adapted to detect values proportional to the differential angle between two ropes and the cosine of the differential angle with reference to one corner reference point at the time of the parallel movement.

Apparatus for Detecting the Differential Angle and the Value proportional to the Cosine of the Differential Angle FIG. 15 shows a detailed connection diagram of the rope orientation angle detector 310 and the deviation operator 330 shown in FIG. 4 by taking ropes 8*a* and 8*h* at the corner reference point C1 as the examples. In FIG. 11, reference numeral 11 shows means for setting the angle of movement which is disposed in the control room 9 on the working ship 1 and constitutes a portion of the information setter 320. Handle 12 of the angle setting means 11 is manually operated to set an orientation angle $\alpha$. A Selsyn transmitter 13 is coupled directly to the shaft of the handle 12, so that the rotor of the Selsyn transmitter 13 is rotated by the angle $\alpha$. The Selsyn transmitter 13 is connected to a Selsyn receiver 16, for example, corresponding to one of the anchor ropes, and included in an orientation angle receiver 15 of the detector 14 for detecting the differential angle and a value corresponding to the cosine thereof, the detector 14 comprising a portion of the deviation operator 330 shown in FIG. 4. Between the Selsyn transmitter 13 and the Selsyn receiver 16 is connected a push button switch 341 which constitutes a portion of the position correction pattern designator and functions to designate a parallel movement pattern. Similarly, push button switches 342 and 343 constitute a portion of the position correction pattern designator 340. As will be described later, at the time of the clockwise swinging operation, switch 342 is closed whereas at the time of the counterclockwise swinging operation, switch 343 is closed.

The rotor of the Selsyn receiver 16 is rotated in the clockwise direction by angle $\alpha$ by the signal transmitted from the Selsyn transmitter 13 so as to rotate spur gears 17 and 18 in the clockwise direction by the same angle $\alpha$. The spur gears 22 and 23 secured to the rotors of the Selsyn receivers 21 and 22 of the rope orientation angle receivers 19 and 20 for ropes 8*a* and 8*b* respectively mesh with the spur gears 17 and 18 so that the rotors of the Selsyn receivers 21 and 22 and spur gears 23 and 24 are rotated in the counterclockwise direction by angle $\alpha$ to position OQ.

Figure 16A:
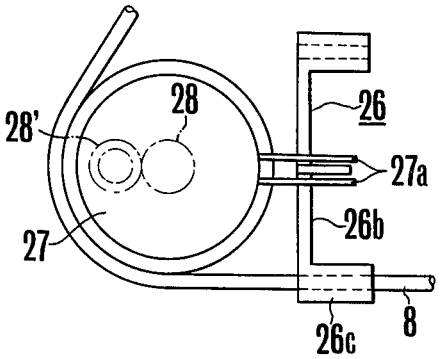
FIG. 16A shows a plan view of one example of the apparatus for detecting the angle.
Figure 16B:
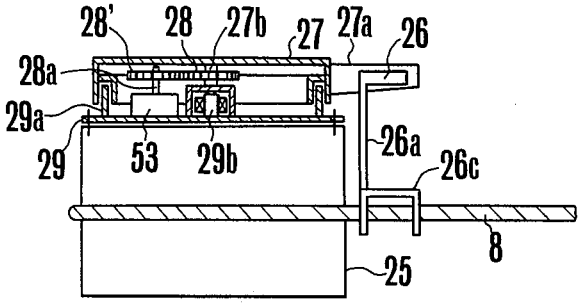
FIG. 16B shows a side view of the apparatus shown in FIG. 16A.

A bollard as shown in FIGS. 16A and 16B or a fairy leader, not shown, is provided for each corner which is a reference point for the rope. As shown, rope 8 surrounds the periphery of the bollard 25 to extend toward the sea. The rope 8 is supported by a rope supporting frame 26 clamped between projections 27*a* secured to a rotary disc 27 mounted on the bollard 25. The rope supporting frame 26 comprises a rod 26*a* having one end engaged by the projections 27*a*, a rope holding arm 26*b* extending from the other end of the rod 26*a* at right angles, and a U shaped rope contacting piece 26*c* mounted on one end of the rope holding arm 26*b*.

As the direction of extension of the rope varies, the rotary disc 27 mounted on the bollard 25 rotates to rotate the gear 28 mounted on the shaft 27*b* of the rotary disc 27. Accordingly the rotor of the Selsyn transmitter 53 connected to the gear 28 via gear 28' and shaft 28'*a*. A base plate 29 including an annular guide 29*a* is mounted on the bollard 25 and the shaft 27*b* of the rotary disc 27 is rotatably connected to a shaft 29*b* secured at the center of the base plate 29. Accordingly, as the direction of extension of the rope varies with respect to the reference line on the working ship in accordance with the parallel movement or swinging movement of the ship the rotary disc 27 also rotates to follow such variation to rotate the rotor of the Selsyn transmitter 53 via gears 28 and 28' thereby rotating the rotor of the Selsyn receiver (not shown) by the same angle.

In this manner, the orientation angles $\beta 1$ and $\beta 2$ of the ropes are detected by the rope orientation angle detecting means described above, which are designated by reference numerals 31 and 32 in FIG. 15. Selsyn transmitters 33 and 34 of these rope orientation angle detecting means are connected to the Selsyn receivers 21 and 22 described above, whereby the rotors OQ thereof rotate in the clockwise direction by angles $\beta 1$ and $\beta 2$, respectively. As shown in FIG. 15, switches 311 and 312 are connected respectively between Selsyn transmitters 33 and 34 and Selsyn receivers 21 and 22. The purpose of these switches is to disconnect the winches from the control system of this invention for manual operation and are immaterial to this invention.

As a result of the above described operation, the rotors of the Selsyn receivers 21 and 22 are rotated $\beta 1 - \alpha = \gamma 1$ and $\beta 2 - \alpha\ \gamma 2$, respectively in the clockwise direction with respect to the reference line OS, where $\gamma 1$ and $\gamma 2$ represent the differential angles. Thus, spur gears 35 and 36 directly coupled to the rotors of the Selsyn receivers 21 and 22 respectively are also rotated by angles $\gamma 1$ and $\gamma 2$ in the clockwise direction with reference to the reference line OS.

Means 37 and 38 for detecting the value proportional to the cosine of the differential angle constitute a portion of the deviation operator 330 and are provided with two spur gears 39 and 40 meshing with said spur gear 35 and two spur gears 41 and 42 meshing with the spur gear 36, and potentiometers 43 and 44 are disposed between the gears 39 and 40 and between gears 41 and 42, respectively. Sliding members 45 and 46 are connected between arms 47, 48 and arms 49 and 50 respectively mounted on the gears 39, 40 and gears 41, 42 respectively. Consequently, when gears 35 and 36 rotate in the clockwise direction by $\gamma 1$ and $\gamma 2$ respectively with respect to the reference line, gears 39, 40, 41 and 42 will be rotated in the counterclockwise direction by $\gamma 1$ and $\gamma 2$, respectively with reference to the reference line OS.

The resistance elements 51 and 52 of the input potentiometers 43 and 44 are respectively divided into two equal sections by straight lines interconnecting the centers of rotation of the arms 47, 48 and arms 49 and 50, respectively. The variations in the resistance values of the resistance elements 51 and 52 are directly proportional to the distances from the centers C1 and C2 respectively of the resistance elements. Denoting the opposite terminals of the resistance elements 51 and 52 by A1, B1 and A2, B2 respectively, the centers by C11 and C12, respectively, and the voltages at the opposite terminals and the centers by $V_{A1}$, $V_{B1}$, $V_{C11}$, and $V_{A2}$, $V_{B2}$, $V_{C12}$ and let us assume that the terminal voltages have relations $V_{A1} = V_{A2} = E$ and $V_{B1} = V_{B2} = -E$ and that the center voltages have a relation $V_{C11} = V_{C12} = \pm 0$. Further, it is assumed that when $\gamma = 0°$, 90° and 180°, voltages E, ±0 and −E are derived out from the input potentiometers 43 and 44, respectively. Denoting the contact point between the resistance element 51 and the sliding member 45 by P1, that between the resistance element 52 and the contact member 46 by P2, and the voltages at these contact points by $V_{P1}$ and $V_{P2}$, respectively, we obtain the following relations:

$$V_{P1}:V_{B1} = V_{P1} :-E$$

$$E \cos \gamma_1 : E \cos 180° = V_{P1}:V_{B1}$$

$$\therefore \cos \gamma_1 : -1 = V_{P1}:-E$$

$$\therefore V_{P1} = E \cos \gamma_1 \text{ or } |V_{P1}| - E|\cos \gamma_1|$$

$$\text{Similarly } V_{P2} = E \cos \gamma_2$$

In this manner, voltages $V_{P1}$ and $V_{P2}$ proportional to the cosines of the differential angles are derived out. By providing above described apparatus for each rope it is possible to detect the differential angle between the orientation angles of the ropes and the cosine of the differential angle as well as the voltages proportional to the differential angle and the cosine, respectively for all ropes.

These voltages $V_{P1}$ and $V_{P2}$ are sent to the rope extension and contraction control device 350 shown in FIG. 4, the operation thereof will be described later in connection with FIG. 17.

The Operation of the Rope Extension and Contraction Control Device During Movement over a Unit Distance The construction and operation of the system for moving the working ship 1 over a unit distance will now be described. As has been described hereinabove this system is constructed such that the ship is moved over the entire stroke $d$ by repeating N times the unit stroke $l_o$. Assuming not that the length of extension and contraction of each rope at the time of the entire travel and unit travel are expressed by $\Delta Ln$ and $\Delta ln$, respectively, we obtain the following relationships:

$$\Delta Ln = d|\cos \gamma n| = N.l_o|\cos \gamma n|$$

$$\Delta ln = l_o|\cos \gamma n|, \ \Delta Ln = N - \Delta ln$$

wherein $\gamma n$ represents differential angle ($n$=1, 2 . . . 8).

Figures 17, 17A:
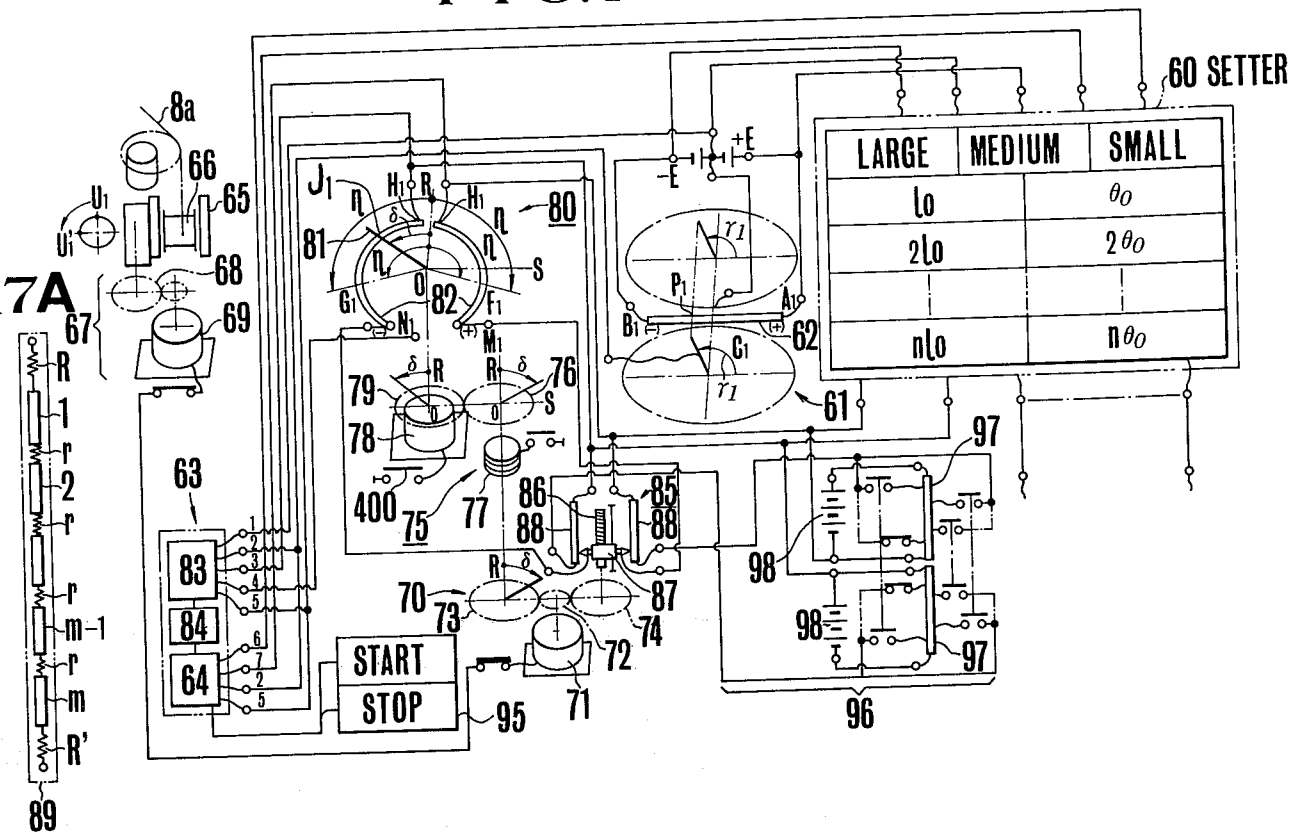
FIGS. 17 and 18 are connection diagrams showing the essential elements of the rope extension and contraction control device, winch devices and a portion of the information setter.
FIG. 17A shows one example of a potentiometer resistor.

Fig. 17 is a connection diagram showing the constructions of portions the rope extension and contraction control device and the information setter 320 when rope 8a moves over a unit distance or stroke. In this figure, reference numeral 60 represents a setter for setting the value of parallel movement and the value of swinging movement which are common to all ropes. The setter 60 constitutes a portion of the information setter 320 and in which the number of repeating cycles, the unit stroke $l_o$ and the magnitude (large, medium and small) of $\theta_o$ (unit swinging angle) are set. There are also provided an output number 61 of the deviation operator 330, which corresponds to the detectors 37 and 38 for detecting the values of the cosines of the differential angles, and a potentiometer 62 corresponding to the input potentiometers 51 and 52 of the detectors 37 and 38. It is assumed now that the voltage impressed upon the input potentiometer 62 is expressed by an equation $V_{P1} = E \cos \gamma 1$ that the differential angle $\gamma 1$ is an acute angle and that $V_{P1} < 0$. Under these conditions the rope is paid out.

The polarity of the voltage across the input potentiometer 62 is detected by a controller 64 for controlling the forward and reverse operation of the winch, which is included in the central control panel 63 in the control room 9 on the working ship 1. In response to the detected polarity the drum 66 of a winch 65 (which is one of the winches 360 shown in FIG. 4) is rotated to pay out the rope 8a. It is now assumed that when the drum 66 rotates from U1 to $U_1'$ as viewed from one side of the drum, the following relation is obtained.

$$U_1 U_1' = l_o|\cos \gamma_1|$$

This rotation of the drum rotates the rotor of a Selsyn transmitter 69 via a motion transmission gearing 67 of a transmitter 67 for transmitting the number of revolutions and the angle of rotation of the drum. The signal from the Selsyn transmitter 69 is transmitted to a Selsyn receiver 71 of a receiver 70 for receiving the number of revolutions and the angle of rotation of the drum. The rotation of the rotor of the Selsyn receiver 71 is transmitted to spur gears 73 and 74 meshing with a pinion 72 carried to the rotor. The gear 76 of an angle transmitting mechansim 76 is connected coaxially with the gear 73 through an electromagnetic clutch 77 which is held in the operative position when the winch drum 66 is rotated. A gear 79 coupled to the rotor of an original resetting Selesyn motor 78 included in the angle transmitting mechanism 75 meshes the spur gear 76 and the sliding member 81 of an output potentiometer 80 is coaxially connected to the shaft of the gear 79 so that when the rope is paid out by a length equal to the length $U_1 - U_1'$ on the periphery of the drum the sliding member will be rotated by S in the counterclockwise direction with reference to the reference line OR.

The resistance element 82 of an output potentiometer 80 is in the form of an area having a center 0. The reference line comprises a line OR extending through the center 0 and the mid point H of the arc. The opposite terminals of the resistance elements are designated by $M_1$ and $N_1$. The variation in the resistance value of the resistance element 82 is linear and proportional to the angle of rotation from the reference time OR. As shown, the arcuate resistance element 82 is divided at the mid point $H_1$ into two sections for the positive and negative voltages.

As the surface of the drum 66 of winch 65 rotates a length $l_o$, the sliding member 81 rotates by an angle $\eta$. Assume now that the points on the resistance element 82 separated from the reference line OR in the clockwise and counterclockwise directions are designated by F1 and G1, respectively and that the voltages of these points and the midpoint H1 are designated by $V_{J1}$, $V_{G1}$ and $V_{H1}$, respectively. Further, it is assumed that the voltages impressed upon the opposite terminals M1 and N1 of the resistance element 82 are adjusted such that $V_{F1}=E$, $V_{G1}=-E$ and $V_{H1}=\pm 0$. As the rope is paid or taken up the voltage of the output potentiometer 80 becomes positive or negative. When the contact point between the resistance element 82 and the sliding member 81 is designated by J1 and the voltage at the contact point is designated by $V_{J1}$, in this example as the rope is paid out the voltage from the output potentiometer 80 is negative. Since $\cos \gamma 1<0$, $\delta:\eta|V_{J1}| : |V_{G1}|$ and since $V_{G1}=-E$, $|V_{J1}| : |V_{Gl}| = |V_{J1}| : E$ and $l_o|\cos \gamma 1| : l_o = |V_{J1}| : E$. Accordingly $V_{J1} = E|\cos \gamma 1|$.

As above described $|V_{P1}|=E|\cos \gamma 1|$, the difference between the voltage of the input potentiometer 62 and the voltage of the output potentiometer 80 is zero which condition is detected by a zero voltage difference detector 83 provided for the central control panel 63 for stopping the operation of the winch 65. Stopping of all winches is detected by a detector 84 which detects that all winches have been stopped.

When the coasting of the winch at the time of stopping is taken into consideration, it is desirable to stop the winch before the length of elongation of the rope on the winch drum reaches $\Delta Ln=l_o|\cos \gamma n|$. Denoting the bias voltage corresponding to the coasting distance by $e_b(e_b>0)$, the voltage of the output potentiometer 80 by $e_o$ and the voltage of the input potentiometer 62 by $e_i$, then $e_i=E \cos \gamma n$. As the voltage $|e_o|$ increases from zero and reaches a condition expressed by an equation $e_i=e_o+e_b$, a stop commanding signal is generated. In this equation when the voltages $e_i$ and $e_o$ are positive, a (+) symbol is used whereas when the voltages $e_i$ and $e_o$ negative, a (−) symbol is used. The value of $e_b$ is determined experimentally but varies somewhat depending upon the magnitude of the unit strike $l_o$. For the purpose of inserting this bias voltage, in this example, as has been described hereinabove, the arcuate resistance element 82 of the output potentiometer 80 is divided into two sections for the positive and negative voltages for inserting positive and negative bias voltages $+e_b$ and $-e_b$ between terminals 2 and 3, and 2 and 1 of the zero voltage difference detector 83. These bias voltages are applied by a setter 60 which constitutes a portion of the information setter 320 and is utilized to set the values of parallel movement and swinging movement. Further, the voltage $e_o$ of the output potentiometer 80 is applied across terminals 3 and 4 or terminals 1 and 4. The circuit is constructed such that it produces a sum voltage $e_b+e_o$ or $-e_b-|e_o|$ depending upon whether the voltage $e_o$ is positive or negative. On the other hand, the voltage of the input potentiometer 62 is impressed across terminals 2 and 5 to be compared with the voltage impressed across terminals 2 and 4.

In the same manner as the resistance element 82 of the output potentiometer 80, the resistance element 88 of a potentiometer 85 for generating a voltage utilized to adjust the length of extension and contraction of the rope in accordance with the layer in which the rope is positioned is also divided into two sections for the positive and negative voltages which correspond to the positive and negative voltages applied to the output potentiometer 80. In the same manner, a potentiometer 97 for producing voltages utilized to set the voltages of the unit parallel movement and the unit swinging movement (the potentiometer 97 being included in a switching member 96 for switching the values between the unit parallel movement and the unit swinging movement) and the source battery 98 are also divided into two sections respectively for the positive and negative voltages.

The reason that these elements are divided into two sections for the positive and negative voltages respectively lies in that these two sections are electrically isolated from each other and do not have any reference point of common potential unless these two sections are electrically interconnected by some means.

As has been described hereinabove, the voltage of the input potentiometer 62 is detected by the winch forward and reverse operation controller 64 for judging whether the rope is to be payed out or taken up thereby driving the winch in an appropriate direction. However, when the value of the voltage $E|\cos \gamma n|$ of the input potentiometer 62 is zero or approximately zero, that is when $|\gamma n|$ is near 90°, it is difficult to correctly judge that whether the absolute value of the voltage is zero or has a small value and the rope is extended or contracted beyond the desired length of extension or contraction due to the fact that the winch coasts a little even when a stop signal is applied thereto after the required amount of parallel or swinging movement. For this reason, in a range near the zero voltage point the winch controller 64 is set such that it does not operate the winch. Such range is termed a "dead zone", and the voltage corresponding to the dead zone is expressed by $\pm e_Z(e_Z>0)$. The value of this voltage $e_Z$ is determined by experiment although it varies somewhat depending upon the magnitude of the unit stroke. The voltage $e_Z$ is impressed upon the terminals 6 and 7 of the winch controller 64 by setter 60 for setting the values of the parallel movement and the swinging movement. Where the absolute value of the voltage of the input potentiometer impressed upon the terminals 2 and 5 is smaller than the voltage $e_Z$, it is assumed that the voltage is in the dead zone and no operation of the winch 65 is performed.

Method of Controlling the Length of the Extension and Contraction of the Rope Due to the Variation in the Layers of the Rope on the Winch Drum Since the rope is wound about the winch drum in a plurality of superposed layers and since the distance of a rope contained in a particular layer and the center of the drum varies in accordance with the radial position of the layer, the length of the rope payed out or taken out by one revolution of the drum is different in accordance with the radial position of the layer. Considering such difference, in accordance with this invention there is provided means for comparing the voltage produced by the input potentiometer with a voltage produced by converting the number of revolutions and the angle required for paying out or taking up the rope by the winch. More particularly as shown in FIG. 17, the revolution of the winch 65 is transmitted to a Selsyn receiver 71 through a Selsyn transmitter 69 so that the rotor of the Selsyn receiver 71 is rotated in accordance with the number of revolutions and the angle of the winch drum to rotate spur gears 73 and 74. A threaded shaft 8*b* of a potentiometer 85 for producing a voltage corresponding to the layer containing the rope is connected to the shaft of the gear 74 so as to drive a sliding member 87 along resistance elements 88. The rotation of the gear 73 is transmitted to gear 76 through a clutch 77 for driving a gear 79 meshing with gear 76. Accordingly, the sliding member 81 of the output potentiometer 80 is rotated along the resistance element 82. The range of operation of this output potentiometer 80 may be within a maximum range of the desired length of extension and contraction of the rope where a unit stroke is to be made.

The resistor 89 shown in FIG. 17A shows a detailed construction of the resistors 88 in which 1, 2 . . . *m* show conductor segments, *r* the sliding surfaces of the resistors and R and R′ show variable resistors.

The reason that the resistors 88 are constituted by serially connected conductor segments and resistor sliding surfaces *r* is to produce the same voltage as far as possible for all turns of the rope contained in respective layers for the purpose of compensating for the difference in the length of the rope extended or contracted caused by the difference in the radial position of the layer. The value of the voltage for each layer is proportional to the average of the distances between the center of the rope in each layer and the axis of the drum. With this measure, it is possible to limit the difference in the length of the extension or contraction of the rope within a small range of error.

Figure 22:
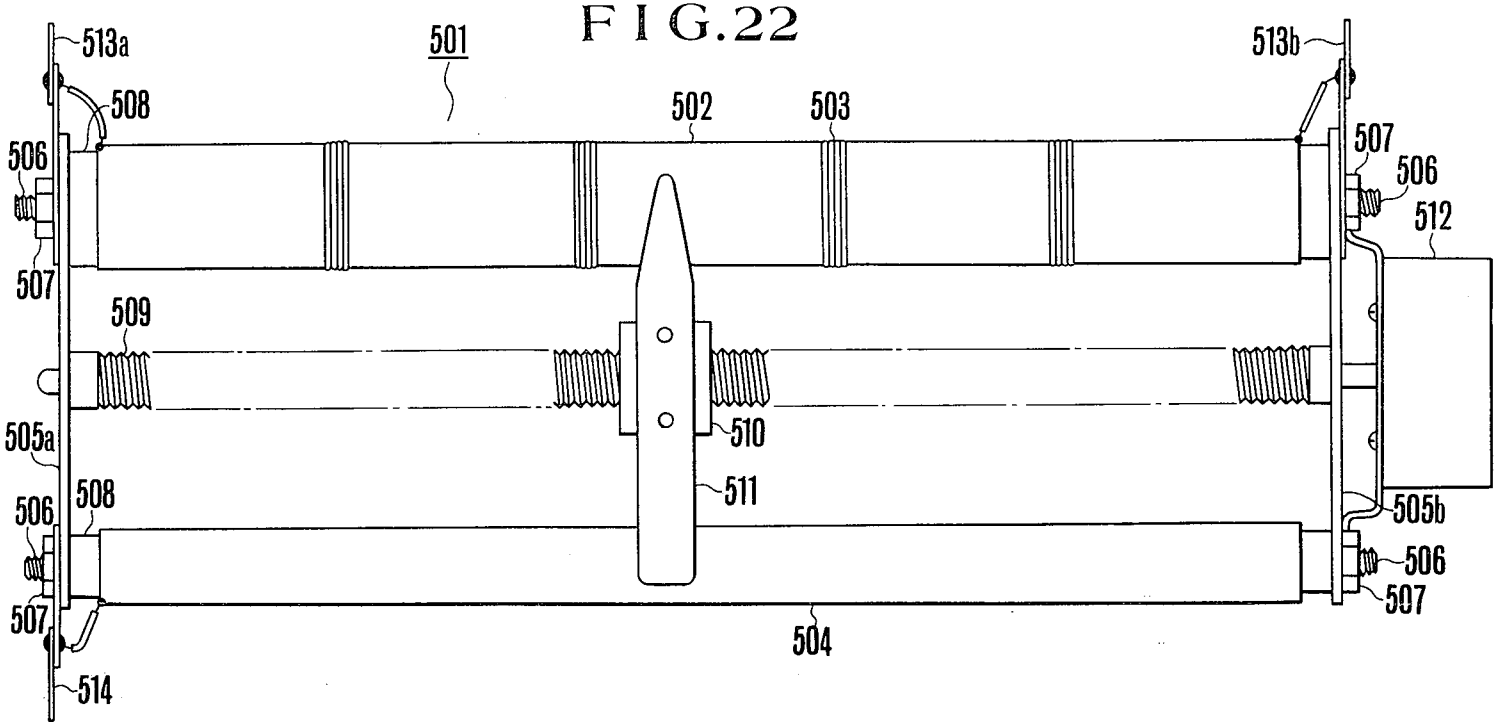
FIG. 22 is a plan view showing the detail of one example of a potentiometer.

FIG. 22 shows the construction of one example of the resistor. More particularly, a resistor 501 is constituted by an alternate arrangement of conductive members 502 having negligibly small resistance and resistance elements 503. A conductive rod 504 having the same length as the resistor 501 is disposed in parallel therewith by means of end plates 505*a* and 505*b*. The resistor 501 and the conductive rod 504 are connected to the end plates by means of bolts 506 extending through the resistor and the conductive rod and the nuts 507. Insulation washers 508 are interposed between the opposite ends of the resistor and conductive rod, and the end plates 505*a* and 505*b* for insulating them from each other.

A threaded rotary shaft 509 is provided between the resistor 501 and the conductive rod 504 for receiving a carriage 510 made of insulator. A slidable member 511 is carried by the carriage 510 for engaging the resistor 501 and the conductive rod 504. The threaded shaft 509 is driven by an electric motor, for example a Selsyn receiver. Terminals 513*a* and 513*b* are connected to the opposite ends of resistor 501 whereas terminal 514 is connected to one end of the conductive rod 504.

However, as this construction is more or less complicated it is advantageous to substitute the conductor segments 1, 2 . . . *m* and the sliding surfaces *r* of the resistors connected between adjacent conductor segments by a potentiometer whose resistance value varies uniformly that is linearly and to make the voltage across the potentiometer to be equal to the voltages across the first and the last conductor segments *l* and *m*. Although this alternative arrangement increases slightly the error, it can be used without causing any trouble. This potentiometer may be of the rotary type.

With the arrangement described above, the potentiometer 85 for compensating for the difference in the radial positions of the rope layers produces a voltage corresponding to the position of the layer on the winch drum which is applied across the terminals of the resistance element 82 of the output potentiometer 80. As the winch drum rotates the voltage appearing at the sliding member of the output potentiometer varies and this output voltage is applied to the zero voltage difference detector 83 to be compared with the voltage set by the input potentiometer 62. When this difference voltage becomes zero, the operation of the winch is stopped.

Figure 18:
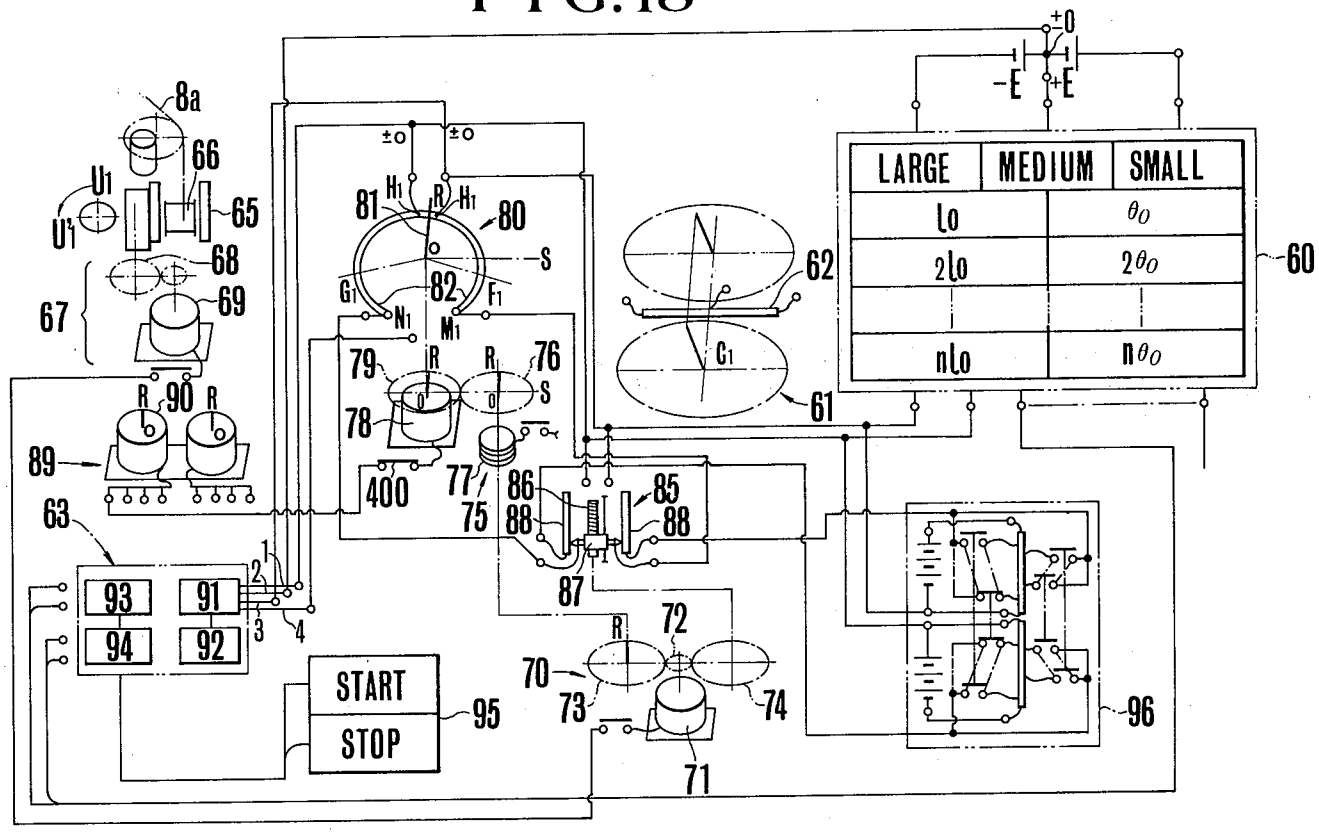

Method of Controlling Resetting of the Output Potentiometer to the Original Position after the Ship has been Moved over a Unit Distance in Each Cycle As described above, in the control system of this invention a small unit movement is repeated to move the working ship in a desired direction over a desired distance. However, it is necessary to reset to the original position the output potentiometer provided for controlling the small unit movement. A method of controlling the resetting of the output potentiometer will be described hereunder with reference to FIG. 18, in which elements identical to those shown in FIG. 17 are designated by the same reference numerals and the description of these elements is not repeated. Assume now that the output potentiometer 80 is stopped with its sliding member 81 stopped at position $J_1$ after completion of the unit stroke or movement. Then the clutch 77 of the angle transmitting mechanism 75 is disengaged. While the reference line of the rotor of the Selsyn transmitter 90 of the means 89 for controlling the resetting of the output potentiometer is fixed to the reference line OR as shown in FIG. 18, the Selsyn transmitter 90 is connected to the Selsyn receiver 79 via switch 400. As a result, the rotor of the Selsyn receiver 78 will reset to the reference line OR. The sliding member 81 of the output potentiometer 80 also resets to the original position. This resetting is confirmed by an output potentiometer reset detector 91 in the central control panel 63. At this time, the voltages across the terminals 1 and 2 and 2 and 3 of the reset detector 91 are made to be zero by the setter 60 for setting the values of parallel movement and swinging movement. Similar apparatus are provided for respective ropes, and the resettings of the output potentiometers 80 for all ropes are confirmed by a detector 92 that detects the resetting of all output potentiometers. A setter 93 for setting one cycle of the unit parallel movement and the unit swinging movement produces a signal which indicates the completion of one cycle which is used to reduce by one the number of cycles set by a setter 94 that sets the number of cycles of the unit strokes to be repeated. In this manner, the small unit movement is repeated N times thus reducing by one the number set by the setter 94 that sets the number of cycles of the unit strokes. When the set value set by the setter 94 is reduced to zero the movement of the ship is completed. Descriptions regarding some additional cases are now to be made.

The first case is the case where it is desired the increase the stroke d during the movement of the ship. In this case after the initially set stroke *d* has been completed, an increase in the stroke is set by the setter 60 and such increase is satisfied by repeating the unit stroke as in the same manner as above described.

The second case is the case where it is desired to decrease the stroke during the movement of the slip. In this case, the count of the setter 94 which sets the number of cycles to be repeated is made to be readable also on the setter 60, and during the movement of the ship, a start-stop button 95 is operated to produce a stop signal.

The third case is the case wherein it is desired to stop the movement of the ship at any point of the movement. In this case the start-stop button 95 is operated to produce a stop signal. Thereafter the operation of the winch is automatically stopped and the Selsyn transmitter 90 of the means 89 for controlling the resetting of the output potentiometer is connected to the Selsyn receiver 78 of the angle transmitting mechanism 75 whereby the output potentiometer is reset to the original position and the count of the setter 94 for setting the number of cycles to be repeated is reset to zero.

The fourth case is the case in which the value of the unit stroke is switched among large, medium and small for applying a voltage inversely proportional to the length $l_o$ across the output potentiometer 80. More particularly, the switching is performed such that at an angle of rotation corresponding to the angle $\eta$ of the output potentiometer 80 the absolute value of the voltage at that angle becomes equal to E. In this manner by switching the voltage of the output potentiometer with respect to a unit value it is possible to make constant the voltage impressed upon the input potentiometer irrespective of the magnitude of the unit value. This switching can be performed by member 96 for switching the value of the unit parallel movement and the unit swinging movement. Alternatively, the switching can be made by changing the gear ratio between the gears 72 and 73 of the Selsyn receiver for receiving the number of revolutions and the angle of the winch drum.

According to the novel control system of this invention, for performing the parallel movement of a working ship moored on the sea by a plurality of anchor ropes, the operator is required to set only the desired direction of movement and the distance to be moved with reference to a reference line on the ship. Then the difference between the direction of extension of the ropes with respect to the reference line on the ship and the orientation angle of the ship is detected and the cosine of the differential angle is calculated automatically. Then the input potentiometer converts a value proportional to the cosine into an electric signal. Each winch is operated to pay out or take up the rope and the number of revolutions and the angle of the winch drum is converted into an electric signal. Upon coincidence of these two signals the operation of the winch is stopped. The extension and contraction of the rope is performed stepwisely by repeating a plurality of small unit strokes. As a result it is possible to smoothly manipulate the ship by a single operator without applying undue forces to the rope.

The detail of the swinging operation will now be described. In the following description, the corner reference point that is the position of a point from which a rope extends is often called a corner.

Figure 19:
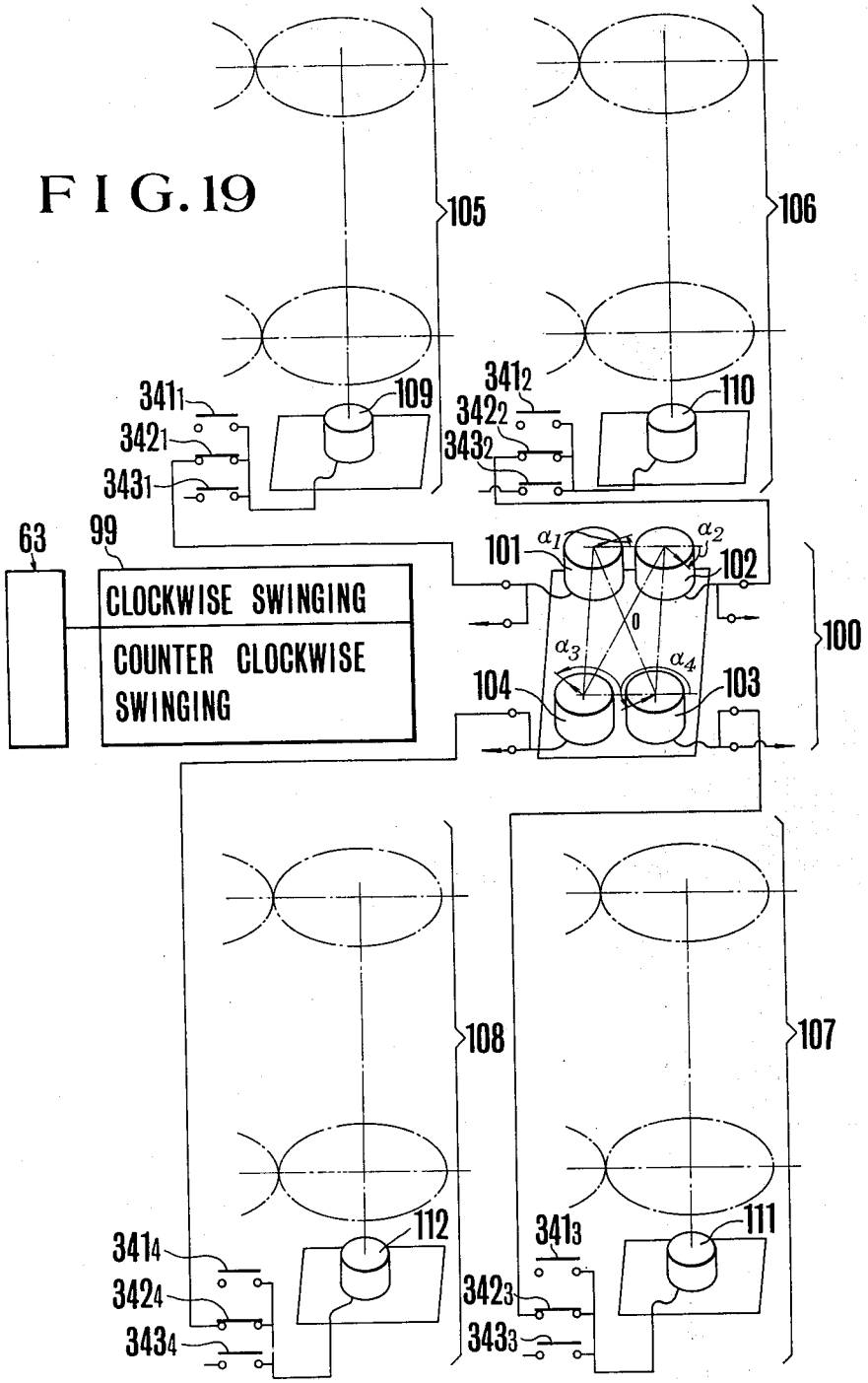
FIG. 19 is a connection diagram for explaining the operation of a setting device at the time of swinging operation, wherein various apparatus are utilized for setting the corner moving angles of four corner reference points at the time of swinging in the clockwise direction.

FIG. 19 is a diagram showing the connection of various elements relating to the setting of the orientation of the corner at the time of swinging movement in the clockwise direction, more particularly the information setter 320 and the position correction pattern designator 340 shown in FIG. 4. The control circuit shown in FIG. 19 comprises the central control panel 63, a switch 79 for selecting the direction of swinging, means 100 for setting the orientation angle of the corner during the swinging movement, and four Selsyn transmitters 101 through 104 corresponding to the four corners of the ship. As diagrammatically shown in FIG. 20, the rotors of the Selsyn transmitters 101 through 104 are normally set to transmit the orientation angles with respect to the center 0 of the ship of the normals extending to the right of the lines OC1 through OC4 that is the orientation angles $\alpha 1$, $\alpha 2$, $\alpha 3$ and $\alpha 4$ of the corner reference points at the time of performing the clockwise swinging movement. The control circuit shown in FIG. 19 is mounted in the control room 9 of the working ship 1. There are provided receivers 105 through 108 for receiving the orientation angles of respective corners and these receivers correspond to the receiver 14 shown in FIG. 15. For the clockwise swinging, a switch 99 for selecting the direction of swinging is used for connecting the Selsyn transmitter 101 to the Selsyn receiver 107 in the orientation angle receiver 105 via switch $342_1$, for connecting the Selsyn transmitter 102 to the Selsyn receiver 110 via switch $342_2$, and for connecting the Selsyn transmitter 103 and 104 to the Selsyn receivers 111 and 112 respectively through switches $342_3$ and $342_4$. Consequently, the rotors of the Selsyn receivers 109 through 112 are rotated by preset angles thus setting the orientation angles of the corner reference points for clockwise swinging. Switches $342_1$, $342_2$, $342_3$ and $342_4$ are arranged to be closed by the operation of the position correction pattern designator 340, more particularly by the operation of the button for clockwise swinging.

Figure 21:
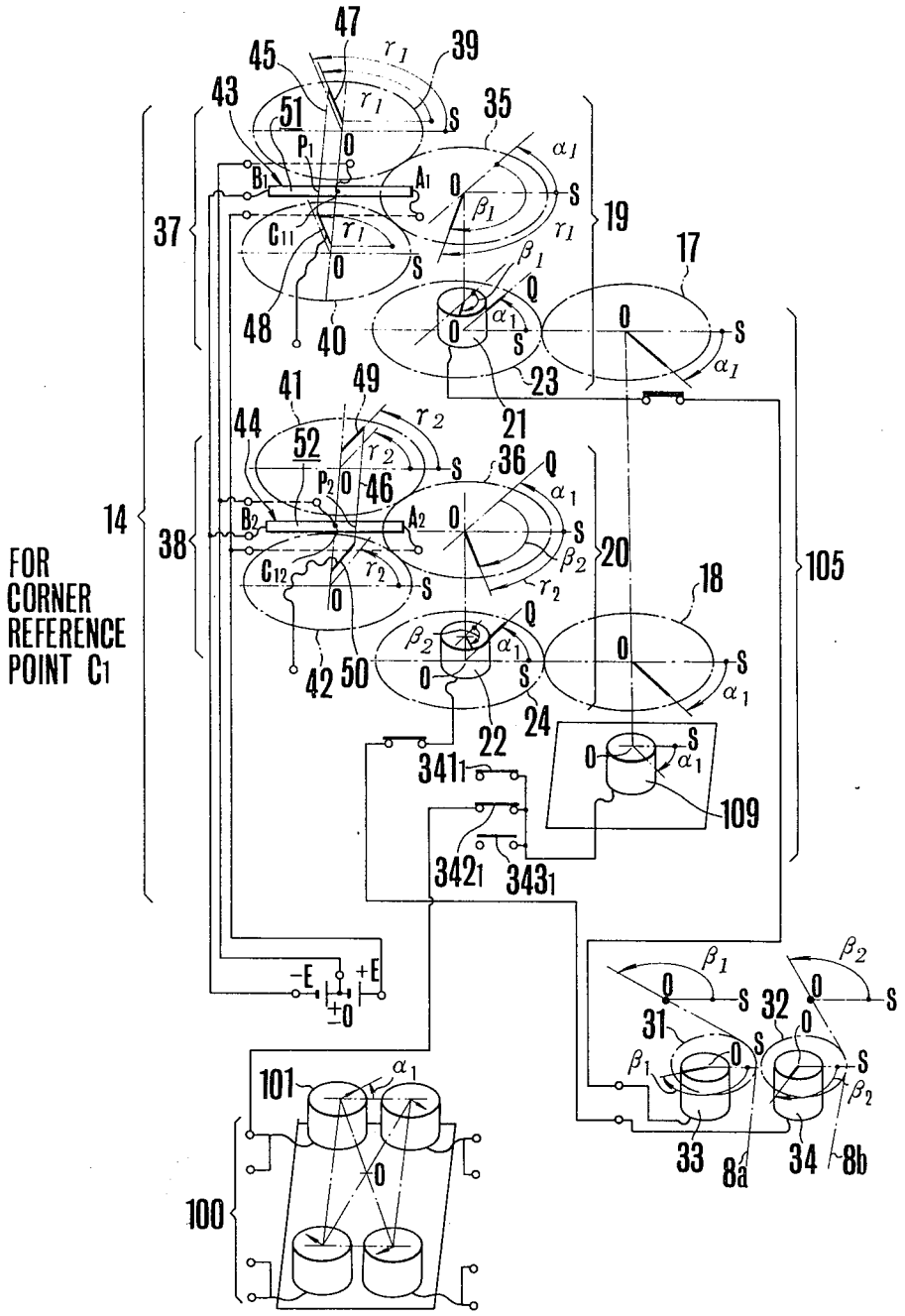
FIG. 21 is a connection diagram useful to explain the operation of the apparatus for detecting the angle of elongation of a rope during the swinging movement and the apparatus for detecting deviation; which shows various apparatus for detecting the differential angle between two ropes and a value proportional to the cosine of the differential angle at the time of clockwise swinging movement by taking one corner point as an example.

Apparatus for Detecting the Differential Angle and a Value Proportional to the Cosine of The Differential Angle FIG. 21 is a diagram for showing the detail of the detector 14 for detecting the differential angle and the cosine thereof which comprises the deviation operator 330 and includes an orientation angle receiver 105, and the connection of the apparatus utilized for performing the clockwise swinging movement with reference to a corner reference point $C_1$. FIG. 21 is identical to FIG. 15 except that the means for setting the angle for the swinging movement and the wirings connected thereto are omitted. Since the rotor of the Selsyn transmitter 101 is normally set to a definite angle $\alpha_1$ the rotor of the Selsyn receiver 109 (corrresponding to the Selsyn receiver 16 shown in FIG. 15) connected to the Selsyn transmitter 101 will rotate by angle $\alpha_1$ in the clockwise direction thus rotating the gears 17 and 18 connected to the rotor of the Selsyn receiver 109 also by angle $\alpha_1$ in the clockwise direction. Thereafter the control system operates in the same manner as in the case of the parallel movement already described in connection with FIG. 15. The differences between rope orientation angles $\beta 1$ and $\beta 2$ obtained by the apparatus for measuring the rope orientation angle shown in FIGS. 16A and 16B, and an angle $\alpha_1$ corresponding to the angle $\alpha$ are produced by the Selsyn receivers 21 and 22 and the values proportional to the cosines of these differential angles are converted into output voltages $V_{P1}$ and $V_{P2}$ by the input potentiometers 43 and 44 of the detectors 37 and 38 which detects the values proportional to the cosines of the differential angles.

Similarly, detectors for detecting the differential angles and the cosines thereof are provided for other corner reference points C2, C3 and C4 and by providing connections similar to that shown in FIG. 15 it is possible to detect the difference between the orientation angles of respective ropes and the cosine of the differential angle thus producing a control voltage proportional thereto for each rope. The voltages produced by the input potentiometers 51 and 52 of detectors 37 and 38 for detecting the values proportional to the cosines of the differential angles are sent to the rope elongation and contraction control device 350.

Method of Controlling the Swinging over a Unit Swinging Angle

With reference again to FIG. 17, the number of cycles to be repeated and the magnitude (large, medium and small) of the unit swinging angle $\theta$ are set in the swinging angle setting section of the setter 60 which constitutes a portion of the information setter 320 and in which the amounts of parallel movement and swinging movement which are common to all ropes are set. The output section 61 which constitutes a portion of the deviation operator 330 corresponds to detectors 37 and 38 for detecting the values proportional to cosines of the differential angles. Output section 61 includes an input potentiometer corrersponding to the input potentiometers 51 and 52.

Let us represent the voltage impressed upon the input potentiometer by $V_{P1} = E \cos \gamma 1$. When it is assumed that the differential angle $\gamma 1$ is an acute angle and that the voltage $V_{P1}<0$, then the rope is payed out. More particularly, the polarity of voltage applied to the input potentiometer 62 is detected by winch operation controller 64 and in accordance with the result of detection the winch is rotated in a direction to pay out or take up the rope. Since in tis example $V_{P1}<0$, the winch drum 66 is rotated in the direction to pay out the rope 8*a*.

It is assumed that when the drum rotates from $U_1$ to $U_1'$ as viewed from one side the following equation holds.

$$U_1 U_1' = \Delta L_1 = d_o |\cos \gamma 1|$$

Such rotation of the drum causes the rotation of the rotor of Selsyn transmitter 69 through the transmitting mechanism of the transmitter 67 for transmitting the number of rotations and the angle of the drum. The signal from the Selsyn transmitter 69 causes the rotor of the Selsyn receiver 71 to rotate and this rotation is transmitted to spur gears 73 and 74 through gear 72 meshing therewith. A gear 76 of the angle transmitting mechanism 75 is connected to the gear 73 through electromagnetic clutch which is engaged when the drum 66 rotates. Gear 79 connected to the rotor of a resetting Selsyn motor provided for the angle transmitting mechanism meshes with a gear 76 and the sliding member 81 of the output potentiometer 80 is mounted on the shaft of gear 79. Accordingly, when the rope is extended by UU' along the surface of the winch drum 66 the sliding member 81 rotates by angle $\delta$ in the counterclockwise direction from the reference line OR. The resistance element 82 of the output potentiometer 80 is formed as an arc having a center 0, opposite ends $M_1$ and $M_2$ and a mid point $H_1$. A line OR extending through 0 and $H_1$ is taken as a reference line. The resistance element has a uniform resistance along its length so that the resistance varies linearly in proportion to the length of the arc and the angle of rotation from the reference line OR. Further, the arcuate resistance element 82 is divided into two sections at the mid point $H_1$ for the positive and negative voltages. It is assumed that when the surface of the winch drum rotates by a length $d_o$, the sliding member 82 rotates by angle $\eta$. Denoting that the points rotated from the reference line OR by angle $\eta$ in the clockwise and counterclockwise directions and the mid point by F, G and H respectively and that the voltages at these points by $V_{F1}$, $V_{G1}$ and $V_{H1}$, respectively and when the voltages impressed upon the opposite terminals $M_1$ and $N_1$ of the resistance element 82 are adjusted such that $V_{F1} = E$, $V_{G1} = -E$, $V_{H1} = \pm 0$. As the rope is payed out or taken up, the voltage of the output potentiometer becomes positive or negative. Denoting the contacting point between the resistance element 82 and the sliding element by $J_1$ and the voltage at that point by $V_{J1}$, since in this example the rope is payed out the voltage is negative. Since $\cos \gamma 1 < 0$, $$\delta : \eta = d_o |\cos \gamma 1| : d_o$$

$$\delta : \eta = |V_{J1}| : |V_{G1}| \text{ and } V_{G1} = -E$$

$$\therefore |V_{J1}| : |V_{G1}| = |V_{J1}| : E$$

$$d_o |\cos \gamma 1| : d_o = |V_{J1}| : E$$

Accordingly $V_{J1} = E \ |\cos \gamma 1|$.

As above described $|V_{P1}| = E \ |\cos \gamma 1|$. Hence the difference between the voltage of the input potentiometer and that of the output potentiometer is zero which is detected by the zero voltage difference detector 83 in the central control panel 63 for stopping the operation of the winch. Stopping of all winches is detected by detector 84.

Coasting of the winch at the time of stopping the same is controlled in the same manner as in the case of parallel movement.

Method of Controlling the Length of the Extension and Contraction of the Rope Due to the Variation in the Layers of the Rope on the Winch Drum This control can be made in the same manner as in the case of the parallel movement. Thus, as has been described with reference to FIG. 17, Selsyn transmitter 69, Selsyn receiver 71, potentiometer 85 for producing a voltage corresponding to the layer containing the rope and output potentiometer 85 are used again.

Thus the potentiometer 85 produces a voltage corresponding to the position of the layer of the rope on the winch drum which is applied across the resistance element 82 of the output potentiometer 80.

As the drum rotates the voltage appearing at the sliding member of the output potentiometer changes and this voltage is applied to the zero voltage difference detector 83 to be compared with the voltage from the input potentiometer 62. When the difference of these two voltages becomes zero winch 65 is stopped. For performing a counterclockwise swinging, swinging direction selection switch 99 shown in FIG. 19 is operated to select the counterclockwise swinging for interconnecting 101 and 111, 102 and 112, 103 and 109, and 104 and 110 respectively, so that the rotors of Selsyns 109 – 112 are rotated 180° in addition to the angles of rotation of respective corners at the time of clockwise swinging. Other operations are similar to those at the time of clockwise swinging.

Method of Resetting the Output Potentiometer to the Original Position After Swinging Over a Unit Angle in Each Cycle This method is similar to the case of the parallel movement which has been described with reference to FIGS. 17 and 18. The fact that all output potentiometers 80 of all ropes have been reset to thir original positions is confirmed by a detector 92. In this case, a setter for setting the period of one cycle in which a unit swinging is performed produces a signal which indicates the completion of one cycle thereby reducing one count, the count set in a setter 94 which sets the number of cycles of repeating the unit swinging. In this manner, the unit swinging movement of a small angle is repeated N times until the count in the setter 94 is reduced to zero at which time the swinging operation is completed.

Certain additional operations are described as follows.

The first case is the case in which it is desired to increase the angle of swinging Ⓗ. In this case after completion of the initially set swinging angle Ⓗ, the additional swinging angle is set in the swinging angle setter 60. Thereafter a number of cycles are repeated in the same manner as above described to perform the swinging corresponding to the additional swinging angle.

The second is a case in which it is desired to decrease the swinging angle. In this case, the count in the setter 94 is made to be readable also in the setter 60 and during the course of the swinging motion, start-stop button 95 is operated to produce a stop signal.

The third is a case wherein it is desired to stop the working ship at any desired point during the swinging movement. In this case when the startstop button 95 is operated to produce a stop signal, the winch is stopped and the Selsyn transmitter 90 of the output potentiometer resetting device 89 is connected to Selsyn receiver 78 of the angle transmitting mechanism 75 for resetting the output potentiometer to the zero point and for resetting to zero the count of the number of cycle setter 94.

The fourth is a case in which the magnitude of the unit swinging angle is desired to be switched among large, medium and small. The value of $d_o$ varies in accordance with the magnitude of angle $Ⓗ_o$ and a voltage inversely proportional to the value of $d_o$ is impressed upon the terminal of the output potentiometer 80. This switching is performed by switching means 96 for switching the unit swinging angle. Alternatively, the switching may be effected by changing the gear ratio of gears 72 and 73 of the receiver for receiving the number of revolutions and the angle of rotation of the winch drum.

As above described, the invention provides a novel position correction system for a working ship moored on the sea by a plurality of anchor ropes, in which where it is desired to swing the ship in the clockwise or counterclockwise direction, the operator is required to set only the clockwise or counterclockwise swinging. Thereafter the orientation angle of each anchor rope with respect to the reference line on the sip is detected, the difference between the orientation angle and the angle of swinging in the selected direction is determined, and the cosine of the differential angle is determined. Then the input potentiometer converts a value proportional to the cosine into an electrical signal for operating the winch to pay out or take up the rope. As the winch operates, its number of revolutions and angle of rotation are transmitted to the outpupt potentiometer through the Selsyn transmitter and receiver and the output potentiometer converts the received signal into a voltage. When this voltage coincides with voltage of the input potentiometer, the operation of the winch is stopped. The elongation and contraction are effected stepwisely be repeating a number of a small unit swinging angle, thus preventing undue tension from being applied to the anchor rope. Thus all operations can be made smoothly by a single operator.

Figure 23:
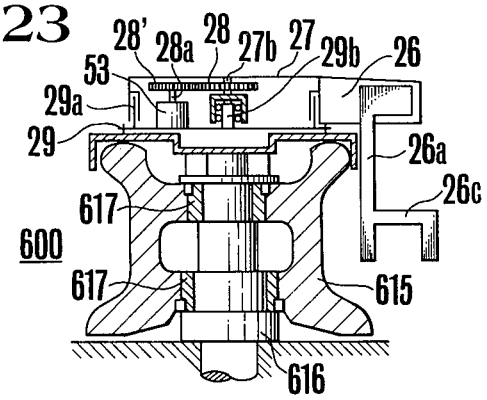
FIG. 23 shows a modification of the apparatus shown in FIGS. 16A and 16B.

While the invention has been shown and described in terms of a specific embodiment it should be understood that the invention is not limited to this specific embodiment. For example, the arrangement shown in FIGS. 16A and 16B can be modified as shown in FIG. 23 in which elements corresponding to those shown in FIGS. 16A and 16B are designated by the same reference numerals. In FIG. 23, a roller 615 is rotatably mounted on a stationary shaft 616 through a bushing 617. The stationary shaft 616 of a fairleader 600 is secured to a base plate 29 and a rotary plate 27 is rotatably mounted on the base plate. This modification operates in the same manner as the bollard.

The transmission and detection of the variation of the angle can also be made by suitable means other than Selsyns, for example a combination of gears or electromagnets.

While in the foregoing embodiment well known analogue meters were used to detect various values necessary for the control, any suitable detecting means can also be used. For example, the deviation operator may comprise a circular potentiometer which is connected to receive a signal representing the orientation angle of the rope and converts the signal into a voltage. The voltage is then converted into a digital quantity of an analogue-digital converter. The distance of parallel movement or the angle of swinging are also converted into an analogue quantity. The difference between these two analogue quantities are converted into a differential angle by a suitable program computer, and the cosine of the differential angle is also operated by the computer.

Instead of obtaining the length of elongation and contraction of the rope caused by the rotation of the winch drum by means of an output potentiometer, the number of revolutions and the angle of rotation of the winch drum may be converted into electric pulses which are counted by a counter.

Further, the control of the length of elongation or contraction of the rope in accordance with the radial position of the layer of the rope on the drum may be accomplished in the following manner. Thus, the number of revolutions of the winch drum is counted and the counted number becomes equal to the total number of convolution of one layer, the radial position of the layer changes. Factors in terms of numerals are prescribed for respective layers and the factors are multiplied by predetermined number of rotation or angle of swinging of the drum by an electronic computer, thus obtaining the result of adjusting the length of elongation or contraction of the rope in accordance with the change of the radial position of the rope layer.

Another method of determing the length of elongation and contraction of the rope is as follows. Thus, the opposite side of the rope is clamped between slip free rollers and the total peripheral length of the rollers in contact with the rope is measured in terms of the number of revolutions of the rollers thus producing an output signal proportional to the length of elongation or contraction of the rope. The conversion of the differential angle can also be made by a combination of a conventional Selsyn receiver and a spur gear or by a differential Selsyn transmitter. In the latter case the receiver for setting the direction and angle of movement is replaced by a differential Selsyn transmitter, and the rope orientation angle given by the receiver is mechanically applied to the rotor thereof to produce a signal corresponding to the differential angle. This differential angle is applied to the gearing of a detector for detecting the value proportional to the cosine of the differential angle. Further, the value of the cosine can be produced by using a cosine potentiometer which produces the value of cosine in accordance with the angle of rotation of the sliding member of the potentiometer.

What is claimed is:

1. A position correction system of a floating body which is moored by at least three anchor ropes extending between said floating body and remote independent stationary anchoring points, said position correction system comprising means for detecting the orientation angle of each anchor rope; means for designating the angle of movement and the amount of movement of said floating body which are necessary to correct the position of said floating body; position correction parameter designating means which determines whether parallel movement of swinging movement is to be performed to correct the position of said floating body and sends the result of determination to said first mentioned means; a deviation operator which compares said angle of movement with said rope orientation angle for producing an output corresponding to the differential angle; a rope extension and contraction control device responsive to the output from said deviation operator and the output from said first mentioned means for producing an output for commanding paying out or taking up of respective anchor ropes; and winches mounted on said floating body for operating respective anchor ropes and controlled by the output from said rope extension and contraction control device; said rope extension and contraction control device including means for increasing or decreasing the length of each anchor rope by one unit length, and means for controlling the next unit length when each extended anchor rope is stabilized after completion of the control of the first unit length thus moving said floating body to a position designated by said first mentioned means in accordance with the determination made by said position correction parameter designating means.

2. The position correction system according to claim 1 wherein said rope extension and contraction control device comprises an input potentiometer for producing a voltage proportional to a desired length of extension and contraction of each anchor rope corresponding to a predetermined unit length of the movement of the floating body, an output potentiometer for producing a voltage proportional to the number of revolutions and the angle of rotation of the drum of the winch, means responsive to a condition wherein the voltages produced by said input and output potentiometers coincide with each other for stopping the operation of said winch whereby the movement of said floating body in the direction and over the distance preset by said means for designating the angle and the amount of movement is performed by repeating the movement of a predetermined unit length a number of times.

3. The position correction system according to claim 1 wherein said rope extension and contraction control device comprises an input potentiometer for producing a voltage proportional to a desired length of extension and contraction of each anchor rope corresponding to a swinging movement of a predetermined unit angle, an output potentiometer for producing a voltage proportional to the number of revolutions and the angle of rotation of the drum of the winch, means responsive to a condition wherein the voltages produced by said input and output potentiometers coincide with each other for stopping the operation of said winch whereby the swinging movement of said floating body in the direction and over the angle preset by said means for designating the angle of movement and the amount of movement is performed by repeating the swinging movement of a predetermined unit angle a number of times.

4. The position correction system according to claim 1 wherein said means for designating the angle of movement and the amount of movement comprises a handle mounted on a control panel for presetting the angle of swinging and the amount of parallel movement of the floating body, an angle transmitter rotated by said handle; said deviation operator comprises a detector for detecting the differential angle between the rope orientation angle and the angle of movement of said floating body and for detecting a value proportional to the cosine of said differential angle; said detector comprising a first angle receiver connected to said angle transmitter, a second angle receiver operated by said means for detecting the orientation angle of the rope, said first and second angle receivers being coupled together to produce a defferential angle; and an input potentiometer having a sliding member operated in accordance with said differential angle so as to produce a voltage corresponding to the cosine of said differential angle.

5. The position correction system according to claim 4 wherein said input potentiometer comprises a linear resistance element which is divided into two equal sections at the midpoint thereof for positive and negative voltages.

6. The position correction system according to claim 4 wherein said angle transmitter comprises a Selsyn transmitter and each one of said first and second angle receiver comprises a Selsyn receiver.

7. The position correction system according to claim 1 wherein said means for designating the angle of movement and the amount of movement comprises a setter for setting the angle of swinging and the amount of parallel movement of said floating body in which the number of times of repeating a predetermined unit movement and the magnitude thereof are set, means including an input potentiometer for detecting a value proportional to the cosine of a differential angle between the orientation angle of the rope and the angle of movement of the floating body, means responsive to the output of said input potentiometer for controlling the operation of the winch, an angle transmitter operatively connected to the drum of said winch, an angle receiver connected to said angle transmitter, and an output potentiometer having a sliding member operated by said angle receiver so as to produce an output voltage proportional to the cosine of said differential angle.

8. The position correction system according to claim 7 which further comprises a zero setting angle receiver which is couplped to said angle receiver for resetting said input potentiometer to the zero position.

9. The position correction system according to claim 7 which further comprises a zero voltage difference detector connected to respond to the difference between the output voltages from said input potentiometer and said output potentiometer for controlling the operation of the winch such that the winch is stopped when said difference between the output voltages becomes zero.

10. The position correction system according to claim 9 wherein said output potentiometer is divided into two sections so as to apply a bias voltage to said zero voltage difference detector whereby the winch is stopped before said difference between the output voltages of the input and output potentiometers becomes zero.

11. The position correction system according to claim 9 which further comprises a controller for controlling the forward and reverse operations of the winch, said controller including means for preventing the operation of said controller in a dead zone in which said difference between the output voltages of said input and output potentiometers is less than a predetermined value.

12. The position correction system according to claim 10 which further comprises a potentiometer resistor having a sliding member which is moved by said angle receiver in response to the rotation of the drum of said winch, and means for applying the output voltage from said potentiometer resistor across said output potentiometer so as to compensate for the difference in the radial position from the axis of the winch drum to a layer of the rope wound about said drum.

13. The position correction system according to claim 12 wherein said potentiometer resistor comprises a plurality of conductive sections and a plurality of resistance sections which are alternately cocnnected in series, a sliding member engaging said potentiometer resistor, and means for driving ssaid sliding member such that when the rope is payed out from or taken up into the same layer of the rope, said sliding member engages the conductive member whereas when the rope is payed out from or taken up into a layer of the rope at a different radial position from the axis of the rotor drum, the sliding member engages the resistance section. .

14. The position correction system according to claim 7 which further comprises a clutch interposed between said angle receiver and said output potentiometer, means for resetting said output potentiometer to the zero position including a second angle transmitter set to the zero position of said output potentiometer and a second angle receiver connected to said second angle receiver and to said sliding member of said output potentiometer.

15. The position correction system according to claim 14 which further comprises a detector which is operated when all output potentiometers at respective corners of the floating body are reset to their zero positions, a setter which sets the number of cycles of a predetermined unit movement, means responsive to the completion of one unit movement for decreasing the number of counts set in said setter.

16. The position correction system according to claim 7 wherein said setter for setting the angle of swinging and the amount of parallel movement includes means for switching the unit angle of swinging and the unit distance of parallel movement among large, medium and small.

17. The position correction system according to claim 7 which further comprises means for selecting the direction of movement of said floating body.

18. The position correction system according to claim 1 wherein said floating body comprises a working ship floating on water, said ship having a configuration of a polygon, two winches are mounted on the respective corners of the polygon and two anchor ropes each operated by said two winches respectively extend in arbitrary directions from each of the corners of the polygon.

19. The position correction system according to claim 18 wherein each pair of winches at respective corners is independently controlled by the output of said rope extension and contraction control device and wherein means is provided which operates when all pairs of the winches complete their operations.

20. The position correction system according to claim 1 wherein said means for detecting the orientation angle of said anchor rope comprises a support mounted on said floating body at each corner thereof, a rotatable disc rotatably mounted on said support, a rope supporting arm secured to one side of said rotatable disc, and a rope contact member mounted on one end of said rope suppporting arm, and wherein said rope passes around said support and is engaged by said rope contact member and thereafter extends toward said anchoring point.

21. The position correction system according to claim 20 wherein an angle transmitter is connected to said rotatable disc for transmitting the angle of rotation thereof to said deviation operator.

22. The position correction system according to claim 20 wherein said support comprises a stationary shaft secured to the floating member, and a roller rotatably mounted on said shaft for engaging the anchor rope, and wherein said rotatable disc is rotatably mounted on said stationary shaft.

* * * * *

UNITED STATES PATENT AND TRADEMARK OFFICE

CERTIFICATE OF CORRECTION

PATENT NO. : 3,948,201

DATED : April 6, 1976

INVENTOR(S) : Isamu Takeda, Ietoshi Yamura, Shojiro Yamada and Yoshio Seki

It is certified that error appears in the above-identified patent and that said Letters Patent are hereby corrected as shown below:

Column 7, line 16, "+90°" should be -- ±90° --;

Column 13, line 22, after"δ:n" insert -- = -- ;

Column 25, line 3, "coplped" should be -- coupled --;

Column 25, line 40, "cocnnected" should be -- connected --;

Column 25, line 42, "ssaid" should be -- said --.

Signed and Sealed this

Twenty-fifth Day of January 1977

[SEAL]

*Attest:*

RUTH C. MASON
*Attesting Officer*

C. MARSHALL DANN
*Commissioner of Patents and Trademarks*